US011849298B2

(12) United States Patent
Wei et al.

(10) Patent No.: US 11,849,298 B2
(45) Date of Patent: Dec. 19, 2023

(54) DIAPHRAGM ASSEMBLY AND LOUDSPEAKER MODULE

(71) Applicant: MERRY ELECTRONICS (SUZHOU) CO., LTD., Jiangsu Province (CN)

(72) Inventors: Pengjiang Wei, Jiangsu Province (CN); Yuanyuan Zhang, Jiangsu Province (CN)

(73) Assignee: MERRY ELECTRONICS (SUZHOU) CO., LTD., Jiangsu Province (CN)

( * ) Notice: Subject to any disclaimer, the term of this patent is extended or adjusted under 35 U.S.C. 154(b) by 9 days.

(21) Appl. No.: 17/741,093

(22) Filed: May 10, 2022

(65) Prior Publication Data

US 2022/0400346 A1 Dec. 15, 2022

(30) Foreign Application Priority Data

Jun. 11, 2021 (CN) ..... 202110651917.8

(51) Int. Cl.
*H04R 7/14* (2006.01)

(52) U.S. Cl.
CPC ..... *H04R 7/14* (2013.01)

(58) Field of Classification Search
CPC ... H04R 7/14; H04R 7/10; H04R 7/20; H04R 31/006; H04R 7/04; H04R 7/02; H04R 7/06; H04R 9/025; H04R 9/045; H04R 9/06
See application file for complete search history.

(56) References Cited

U.S. PATENT DOCUMENTS 8,422,723 B2 * 4/2013 Takewa ..... H04R 7/04 381/396
2019/0373360 A1 12/2019 Yu et al.

FOREIGN PATENT DOCUMENTS

| | | | |
|---|---|---|---|
| CN | 206118013 | U | 4/2017 |
| CN | 107277718 | A | 10/2017 |
| CN | 112235698 | A | 1/2021 |
| CN | 213244359 | U | 5/2021 |
| CN | 213388136 | U | 6/2021 |
| CN | 214381360 | U | 10/2021 |
| CN | 214707976 | U | 11/2021 |
| CN | 215734808 | U | 2/2022 |
| TW | 201129112 | A1 | 8/2011 |
| TW | M506436 | U | 8/2015 |

* cited by examiner

*Primary Examiner* — Brian Ensey
(74) *Attorney, Agent, or Firm* — Birch, Stewart, Kolasch & Birch, LLP

(57) ABSTRACT

Disclosed in embodiments of the present disclosure are a diaphragm assembly, a loudspeaker module and an electronic device, the diaphragm assembly including a diaphragm body and an intermediate patch plate, wherein the diaphragm body includes a first diaphragm body and a second diaphragm body; the first diaphragm body is provided with a first hole; the intermediate patch plate includes a first intermediate patch plate; the second diaphragm body at least partially cover the first hole; the first intermediate patch plate is respectively connected to the first diaphragm body and the second diaphragm body; the first intermediate patch plate is configured to have an enclosed structure, or the intermediate patch plate includes a second intermediate patch plate connected to the second diaphragm body, such that the mid-high frequency curves of the loudspeaker module are smoother, thereby effectively improving the mid-high frequency tone quality.

16 Claims, 30 Drawing Sheets

DIAPHRAGM ASSEMBLY AND LOUDSPEAKER MODULE

CLAIM OF PRIORITY AND CROSS-REFERENCE TO RELATED APPLICATION

This application claims the benefit of Chinese Patent Application No. 202110651917.8, filed on Jun. 11, 2021, entitled "Diaphragm Assembly, Loudspeaker Module and Electronic Device", which is incorporated herein by reference in its entirety.

BACKGROUND OF THE DISCLOSURE

1. Field of the Disclosure

The present disclosure relates to the technical field of electro-acoustic conversion, and more particularly to a diaphragm assembly, a loudspeaker module and an electronic device.

2. Description of the Related Art

Loudspeaker is a common electro-acoustic conversion device. A large number of electronic products configure a loudspeaker to play sound. The electronic product gradually develops to miniaturization and thinness, therefore the space for configuring a loudspeaker module in the electronic product becomes smaller and smaller, which puts forward a higher requirement for the miniaturization of the loudspeaker module. In the prior art, in order to reduce the volume of a small or miniature loudspeaker module, some of the tone effect is correspondingly sacrificed, thereby affecting the use experience of a user. In order to improve the use experience of the user, it is required to design a loudspeaker module giving consideration to miniaturization and good acoustic performance.

BRIEF DESCRIPTION OF THE DISCLOSURE

The objective of the embodiments of the present disclosure is to provide a diaphragm assembly, a loudspeaker module and an electronic device, capable of solving the above problem existing in the prior art.

In the first aspect, embodiments of the present disclosure provide a diaphragm assembly, including a diaphragm body and an intermediate patch plate, wherein the diaphragm body includes a first diaphragm body and a second diaphragm body; the first diaphragm body is provided with a first hole; the second diaphragm body at least partially covers the first hole; the intermediate patch plate is connected to the diaphragm body, and includes first intermediate patch plate; the first intermediate patch plate is connected to the first diaphragm body and the second diaphragm body; and the first intermediate patch plate has an enclosed structure.

Further, a first concavity portion is disposed in the middle of the first intermediate patch plate; the second diaphragm body is provided with a second hole; and the first concavity portion is accommodated in the second hole.

Further, the first diaphragm body includes an outer connecting portion, an inner connecting portion, and a corrugated rim disposed between the outer connecting portion and the inner connecting portion; the first intermediate patch plate is connected to the inner connecting portion; and the outer connecting portion is used to fixedly mount the diaphragm assembly.

Further, the second diaphragm body has an enclosed structure.

Further, the second diaphragm body is provided with a second hole.

Further, the first diaphragm body and the second diaphragm body are connected to the same side surface of the first intermediate patch plate; or the first diaphragm body and the second diaphragm body are connected to different side surfaces of the first intermediate patch plate.

In the second aspect, embodiments of the present disclosure further provide another diaphragm assembly, including a diaphragm body and an intermediate patch plate, wherein the diaphragm body includes a first diaphragm body and a second diaphragm body; the first diaphragm body is provided with a first hole; the second diaphragm body at least partially covers the first hole; the intermediate patch plate is connected to the diaphragm body, and includes a first intermediate patch plate and a second intermediate patch plate; the first intermediate patch plate is provided with a third hole; the second intermediate patch plate is disposed in the third hole; the first intermediate patch plate is connected to the first diaphragm body and the second diaphragm body; and the second intermediate patch plate is connected to the second diaphragm body.

Further, the second intermediate patch plate has an enclosed structure.

Further, a second concavity portion is disposed in the middle of the second intermediate patch plate; the second diaphragm body is provided with a second hole; and the second concavity portion is accommodated in the second hole.

Further, the second intermediate patch plate is provided with a fourth hole.

Further, a gap is disposed between the second intermediate patch plate and inwall of the third hole.

Further, the first intermediate patch plate and the second intermediate patch plate are connected to the same side surface of the second diaphragm body; or the first intermediate patch plate and the second intermediate patch plate are connected to different side surfaces of the second diaphragm body.

Further, the first diaphragm body includes an outer connecting portion, an inner connecting portion, and a corrugated rim disposed between the outer connecting portion and the inner connecting portion; the first intermediate patch plate is connected to the inner connecting portion; and the outer connecting portion is used to fixedly mount the diaphragm assembly.

Further, the second diaphragm body has an enclosed structure.

Further, the second diaphragm body is provided with a second hole.

Further, the first diaphragm body and the second diaphragm body are connected to the same side surface of the first intermediate patch plate; or the first diaphragm body and the second diaphragm body are connected to different side surfaces of the first intermediate patch plate.

In the third aspect, embodiment of the present disclosure further provide a loudspeaker module, including a frame, a magnetic circuit system, and a vibration system, wherein the magnetic circuit system is used to form a magnetic field; the vibration system includes a voice coil and the diaphragm assembly as described in the first aspect or the second aspect; the diaphragm body is connected to the frame; the voice coil is disposed in the magnetic field formed by the magnetic circuit system; the voice coil is configured to drive the diaphragm assembly to vibrate under the drive of the varying magnetic field generated by the magnetic circuit system.

In the fourth aspect, embodiments of the present invention further provide an electronic device, including at least one loudspeaker module as described in the third aspect.

Provided in embodiments of the present disclosure are a diaphragm assembly, a loudspeaker module and an electronic device, the diaphragm assembly including a diaphragm body and an intermediate patch plate, wherein the diaphragm body includes a first diaphragm body and a second diaphragm body; the first diaphragm body is provided with a first hole; the intermediate patch plate includes a first intermediate patch plate; the second diaphragm body at least partially cover the first hole; the first intermediate patch plate is respectively connected to the first diaphragm body and the second diaphragm body; the first intermediate patch plate is configured to have an enclosed structure, or the intermediate patch plate includes a second intermediate patch plate connected to the second diaphragm body, such that the mid-high frequency curves of the loudspeaker module are smoother, thereby effectively improving the mid-high frequency tone quality; furthermore, the diaphragm assembly has a compact structure, thereby facilitating the miniaturization of the loudspeaker module and the electronic device.

BRIEF DESCRIPTION OF THE DRAWINGS

Through the following description of the embodiments of the present disclosure with reference to the drawings, the above and other objectives, features and advantages of the present disclosure will become more apparent, wherein.

DESCRIPTION OF REFERENCE SIGNS

X, diaphragm assembly;

11, first diaphragm body; 111, first hole; 112, outer connecting portion; 113, inner connecting portion; 114, corrugated rim;

21, second diaphragm body; 22, second diaphragm body; 221, second hole;

31, first intermediate patch plate; 32, first intermediate patch plate; 321, first concavity portion; 33, first intermediate patch plate; 331, third hole;

41, second intermediate patch plate; 42, second intermediate patch plate; 421, second concavity portion; 43, second intermediate patch plate; 431, fourth hole;

50, voice coil;

60, housing; 61, frame; 62, sound guide tube;

70, magnetic circuit system.

DETAILED DESCRIPTION OF EMBODIMENTS OF THE DISCLOSURE

The present disclosure is described below on the basis of the embodiments, but is not merely limited to these embodiments. Specific details are described in detail in the following detailed description of the present disclosure. The present disclosure can also be fully understood by a person skilled in the art without the description of the details. In order to avoid confusing the essence of the present disclosure, commonly known method, process, flow, element and circuit are not described in detail.

In addition, a person skilled in the art should understand that the drawings herein are provided for the purpose of description only, and are not necessarily drawn in proportion.

Unless otherwise stated, the terms "comprise", "include" and the like in the specification shall be interpreted as inclusive rather than exclusive or exhaustive; in other words, the terms mean "include but not limited to".

In the descriptions of the present disclosure, it should be understood that the terms like "first", "second" and the like are used for the purpose of description only, but cannot be considered to indicate or imply relative importance. In addition, in the descriptions of the present disclosure, unless otherwise stated, the meaning of "a plurality of" is two or more.

Figure 1:
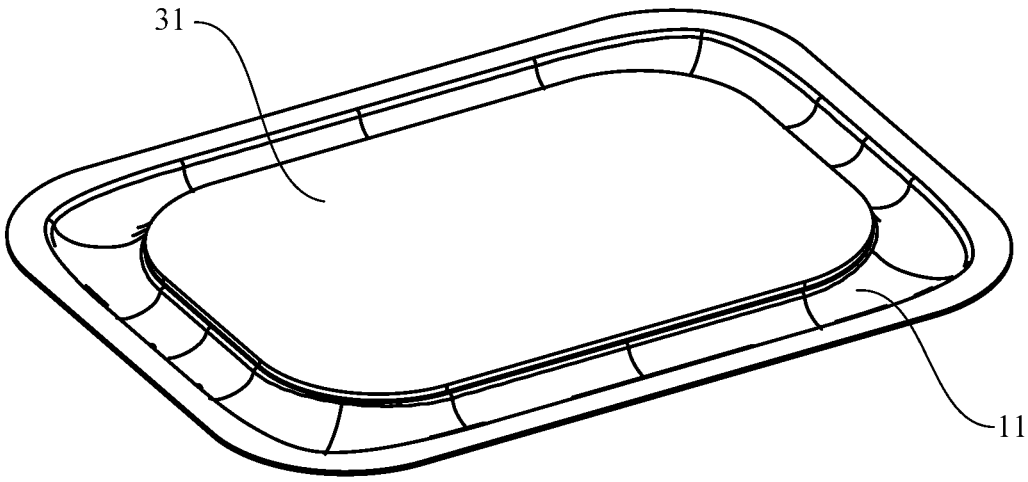
FIG. 1 is a stereoscopic structural schematic view of the first embodiment of the diaphragm assembly according to embodiments of the present invention.
Figure 2:
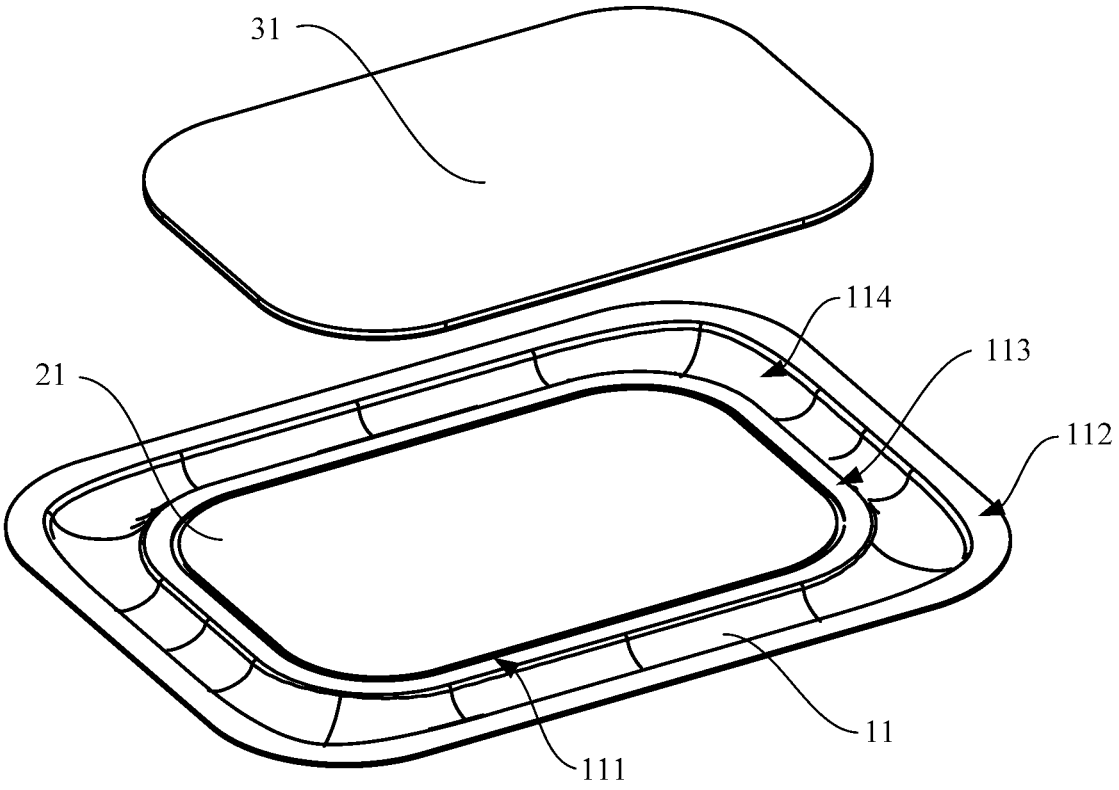
FIG. 2 is an exploded schematic view of the first embodiment of the diaphragm assembly according to embodiments of the present invention.
Figure 3:
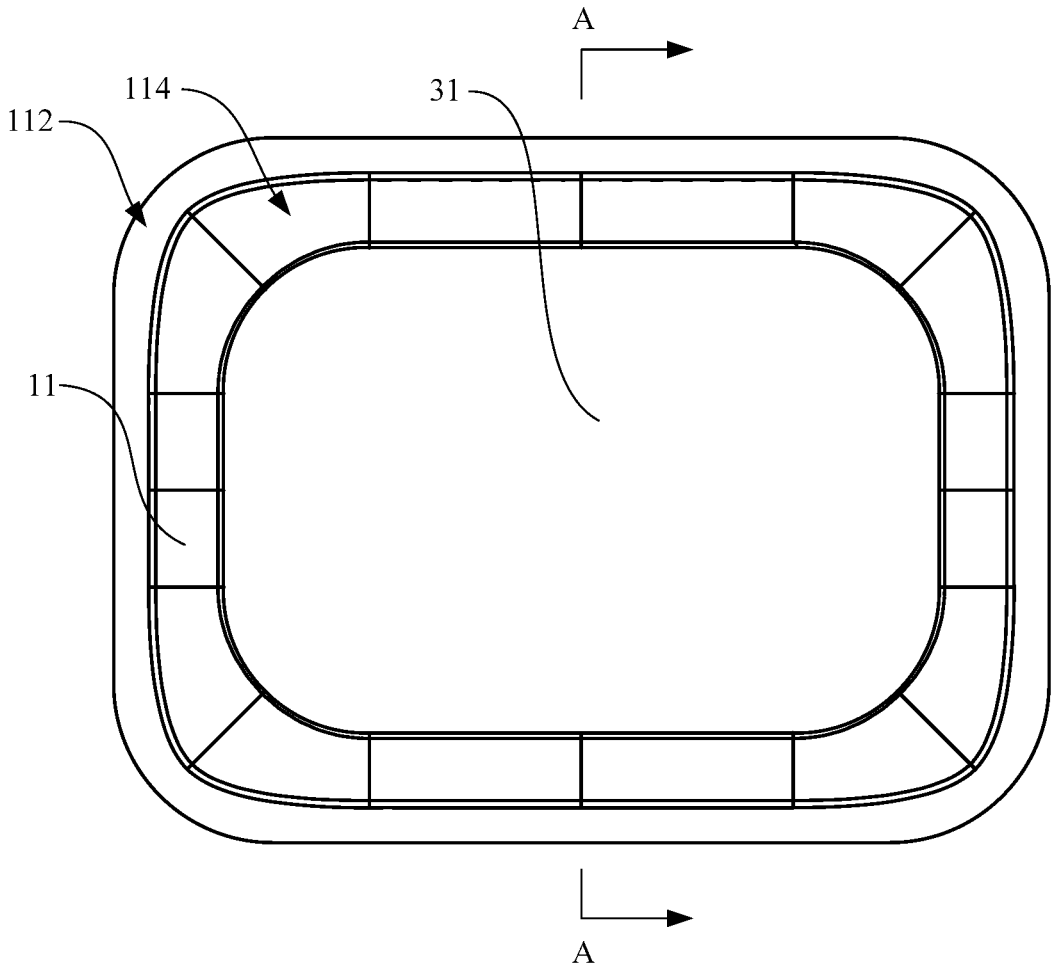
FIG. 3 is a vertical view of the first embodiment of the diaphragm assembly according to embodiments of the present invention.
Figure 4:
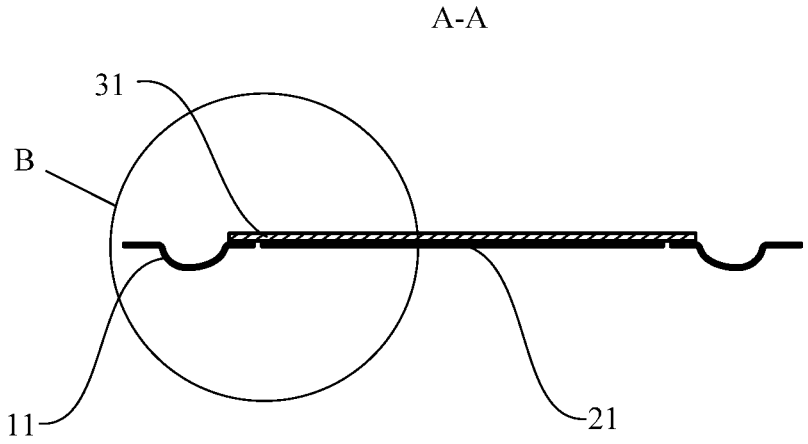
FIG. 4 is a schematic view of a section cut open along the plane A-A of the first embodiment of the diaphragm assembly according to embodiments of the present invention.
Figure 5:
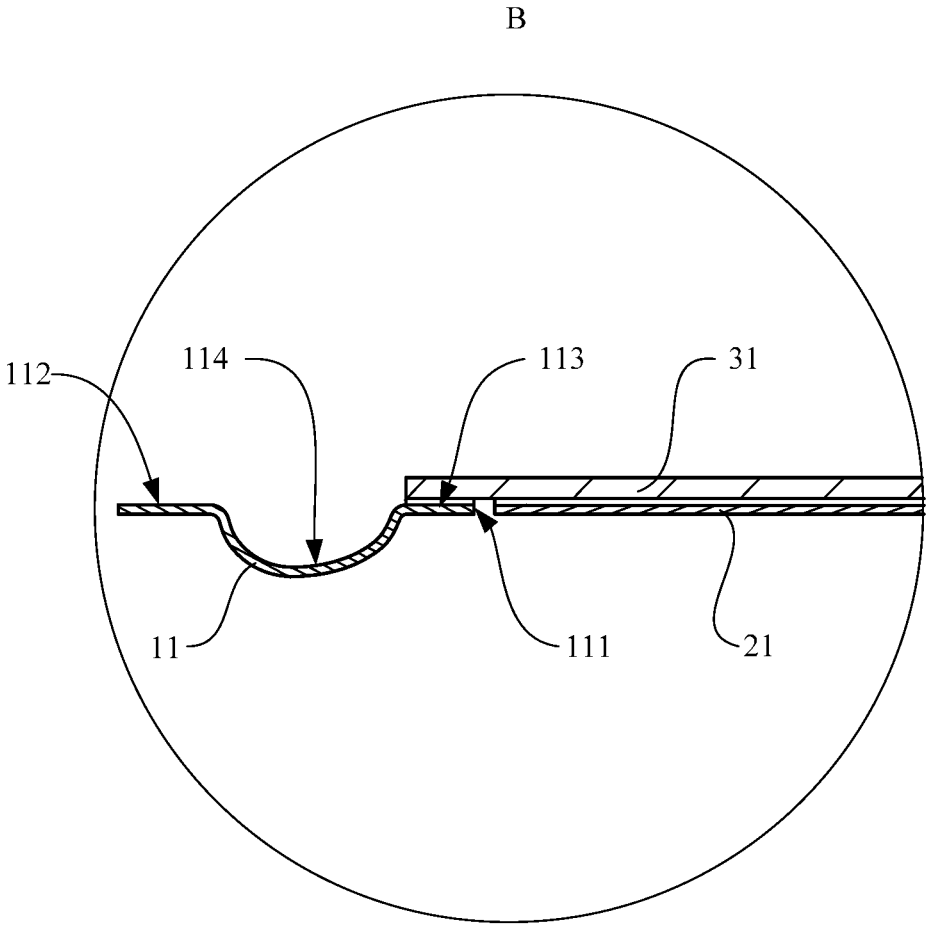
FIG. 5 is a local enlarged schematic view at the position B of the first embodiment of the diaphragm assembly according to embodiments of the present invention.
Figure 6:
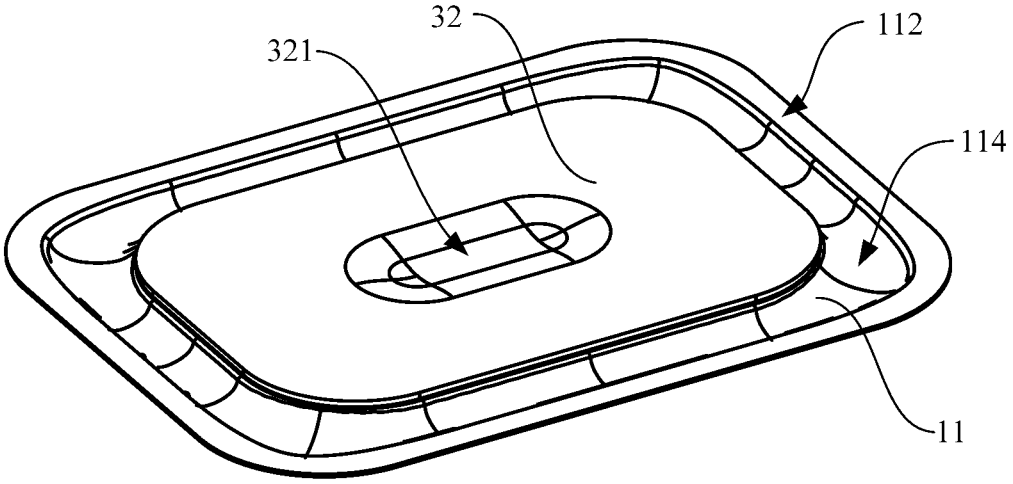
FIG. 6 is a stereoscopic structural schematic view of the second embodiment of the diaphragm assembly according to embodiments of the present invention.
Figure 7:
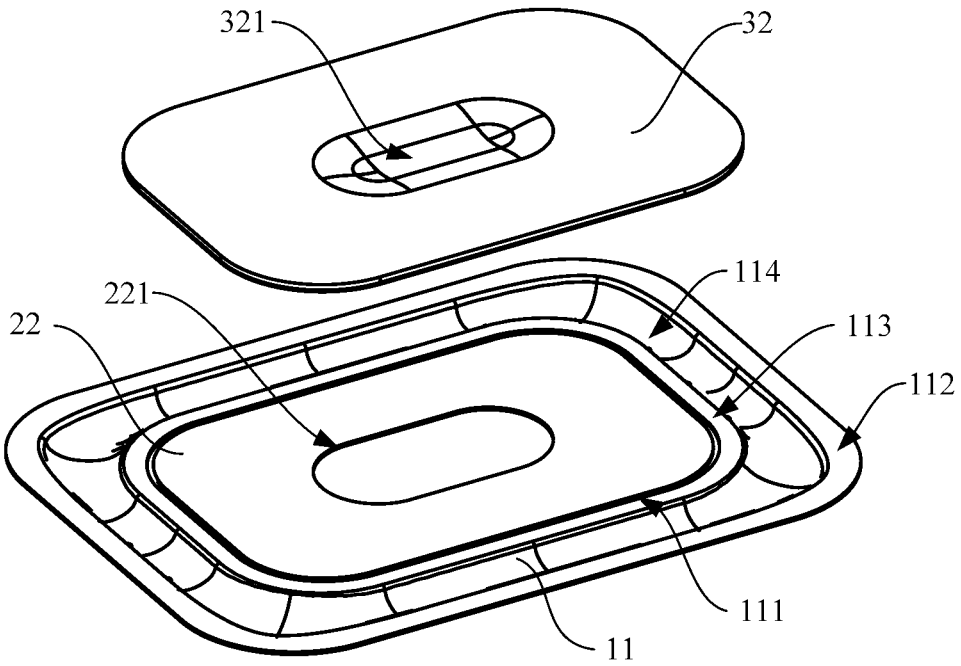
FIG. 7 is an exploded schematic view of the second embodiment of the diaphragm assembly according to embodiments of the present invention.
Figure 8:
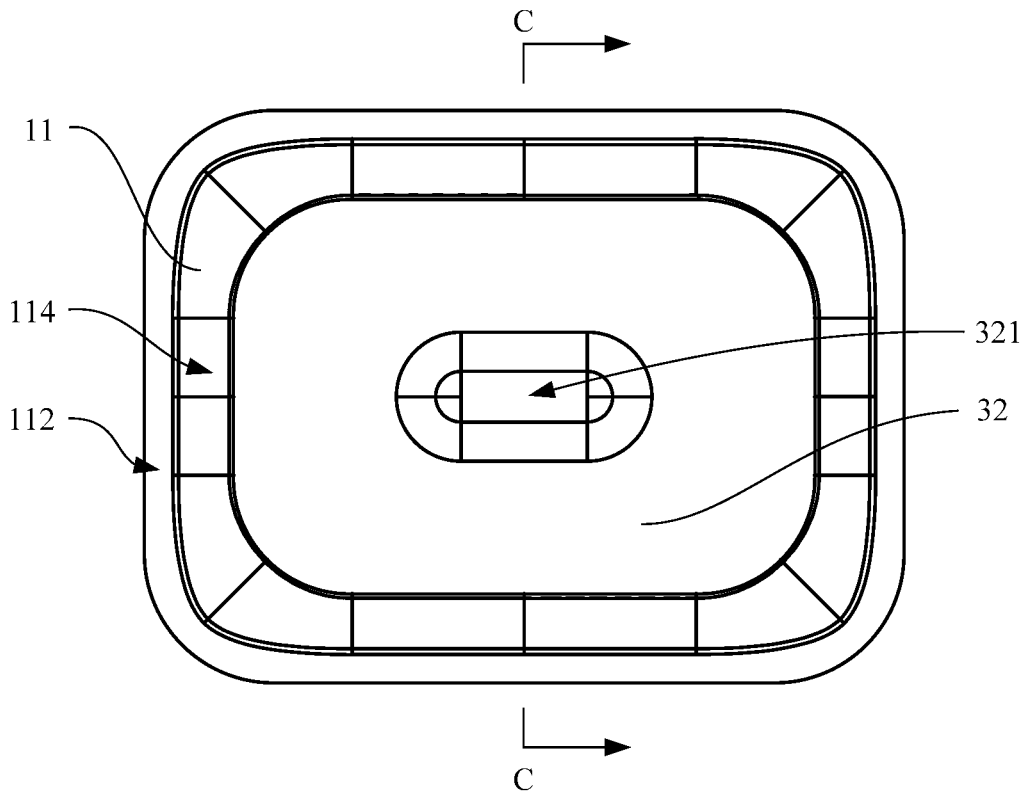
FIG. 8 is a vertical view of the second embodiment of the diaphragm assembly according to embodiments of the present invention.
Figure 9:
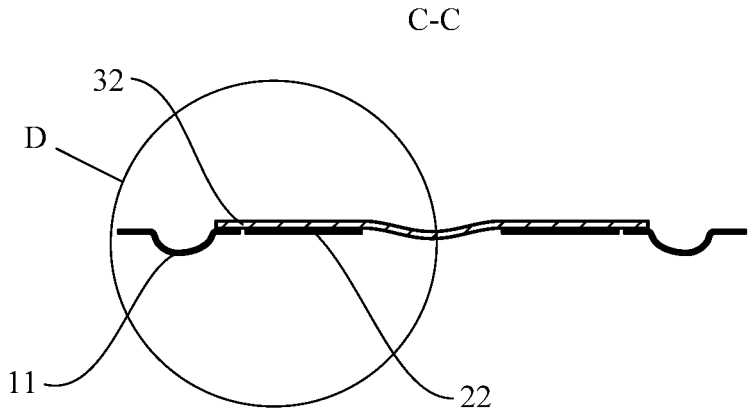
FIG. 9 is a schematic view of a section cut open along the plane C-C of the second embodiment of the diaphragm assembly according to embodiments of the present invention.
Figure 10:
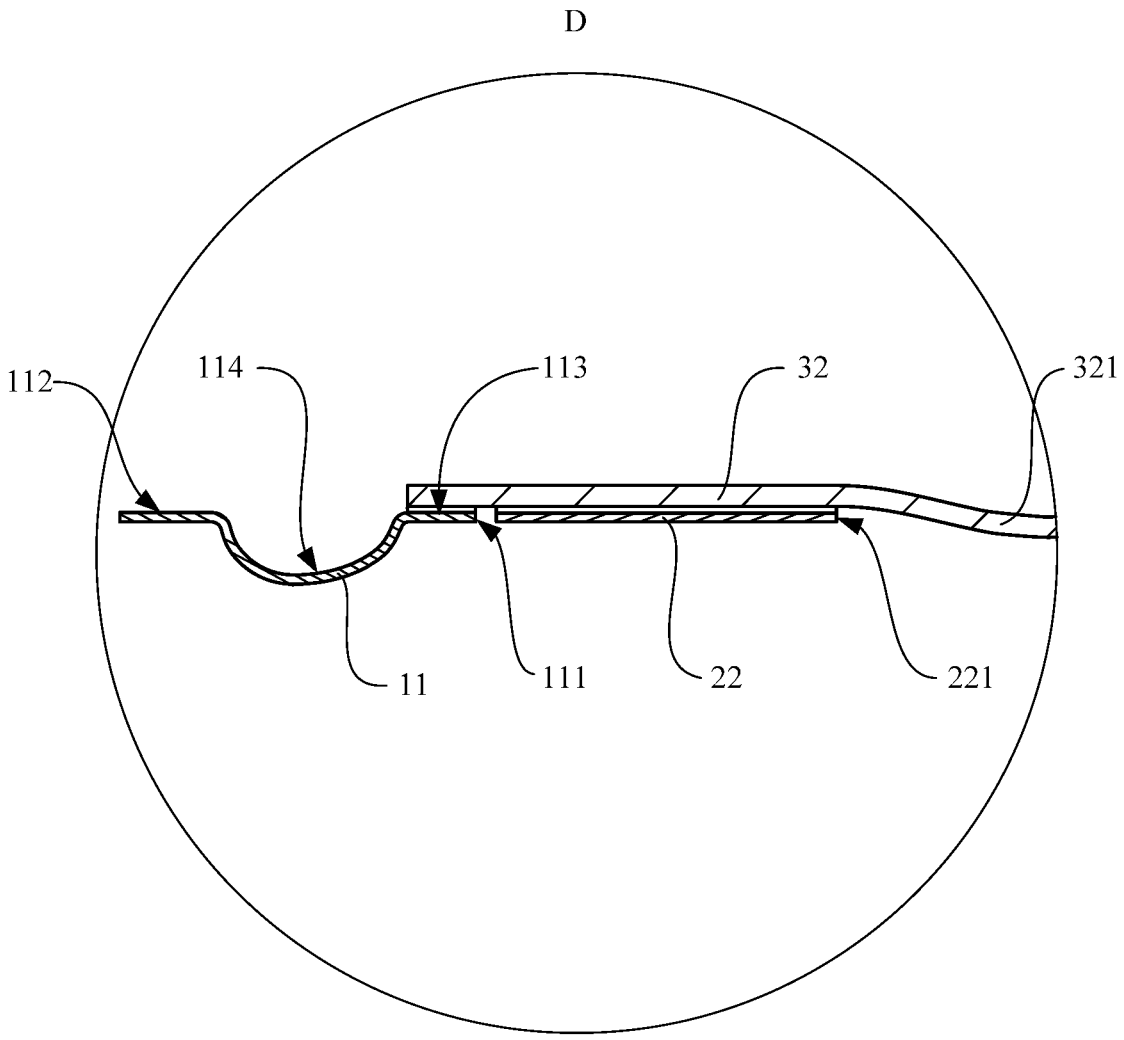
FIG. 10 is a local enlarged schematic view at the position D of the second embodiment of the diaphragm assembly according to embodiments of the present invention.
Figure 11:
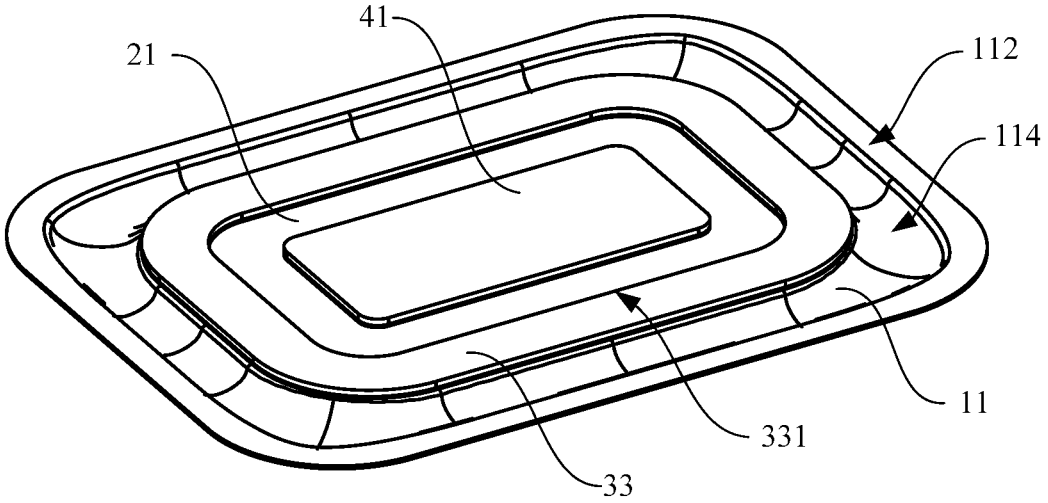
FIG. 11 is a stereoscopic structural schematic view of the third embodiment of the diaphragm assembly according to embodiments of the present invention.
Figure 12:
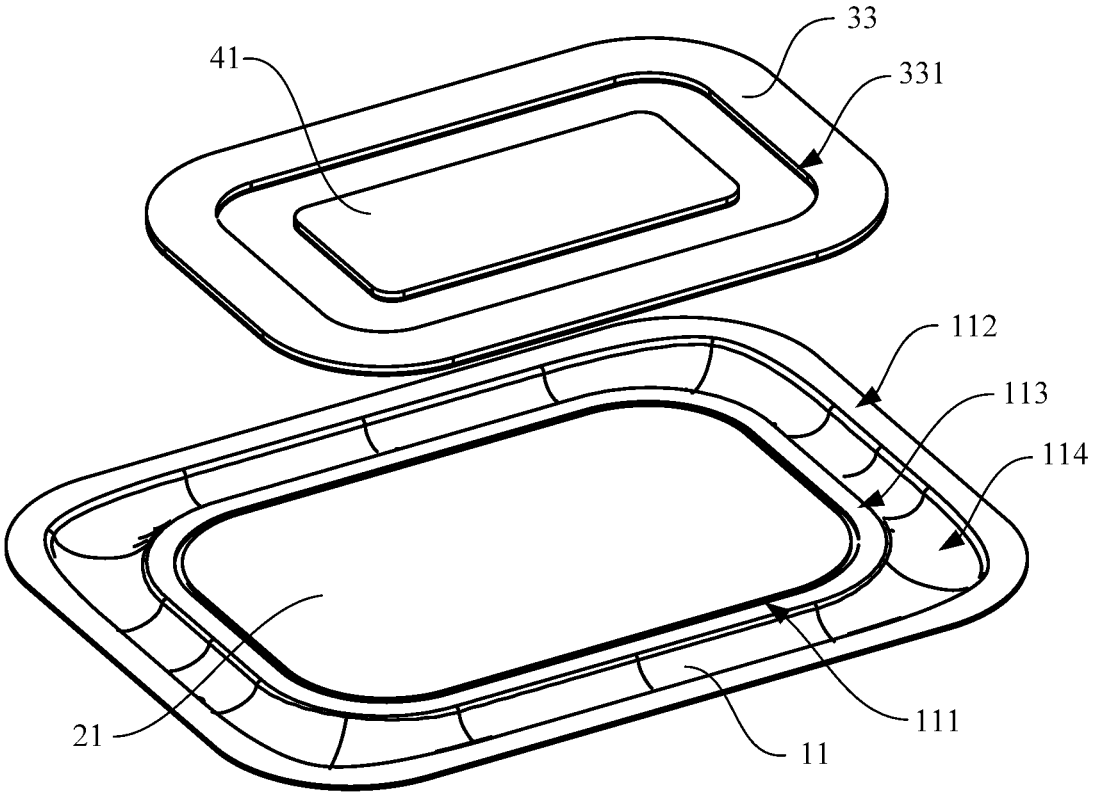
FIG. 12 is an exploded schematic view of the third embodiment of the diaphragm assembly according to embodiments of the present invention.
Figure 13:
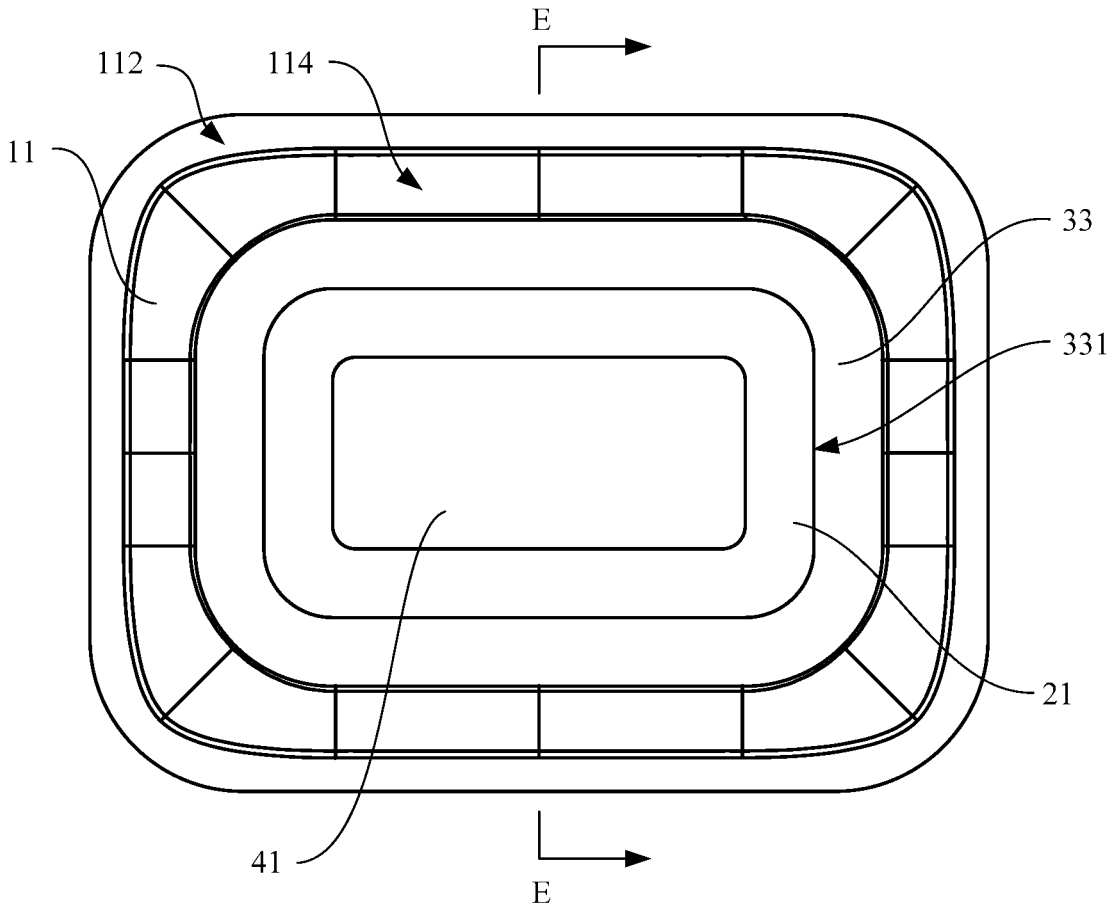
FIG. 13 is a vertical view of the third embodiment of the diaphragm assembly according to embodiments of the present invention.
Figure 14:
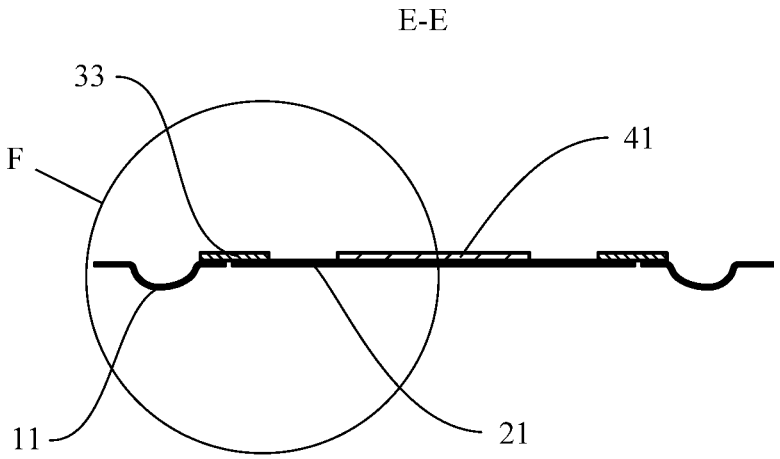
FIG. 14 is a schematic view of a section cut open along the plane E-E of the third embodiment of the diaphragm assembly according to embodiments of the present invention.
Figure 15:
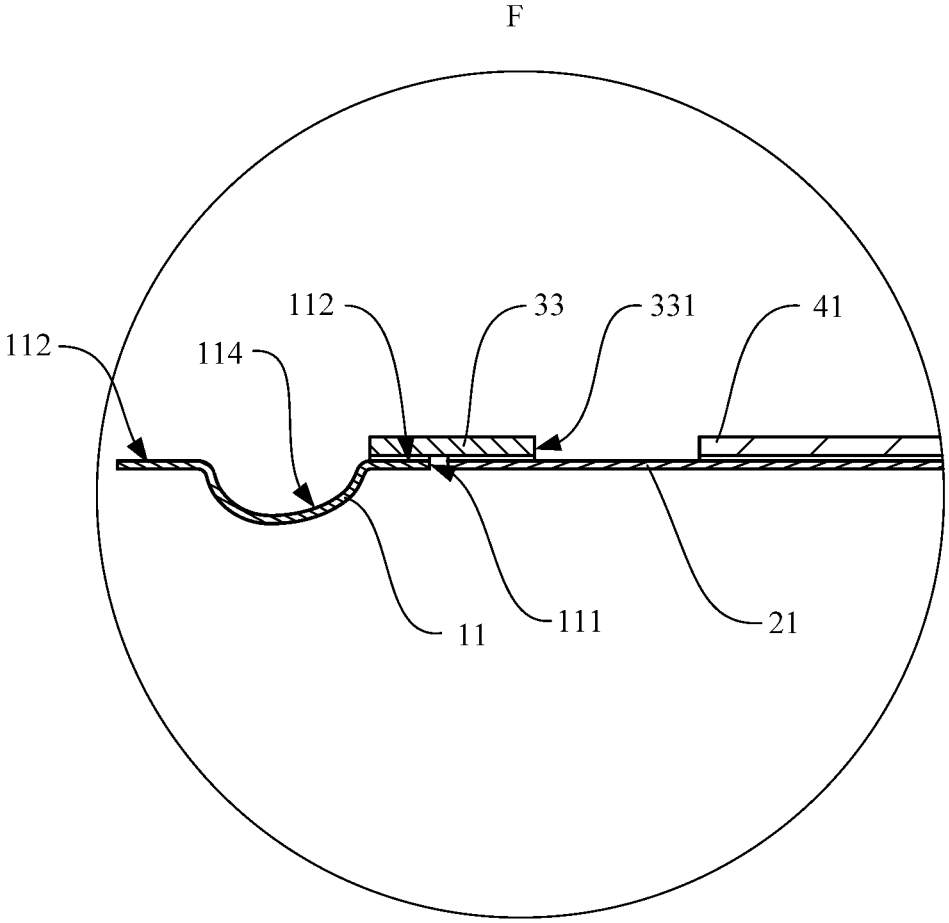
FIG. 15 is a local enlarged schematic view at the position F of the third embodiment of the diaphragm assembly according to embodiments of the present invention.
Figure 16:
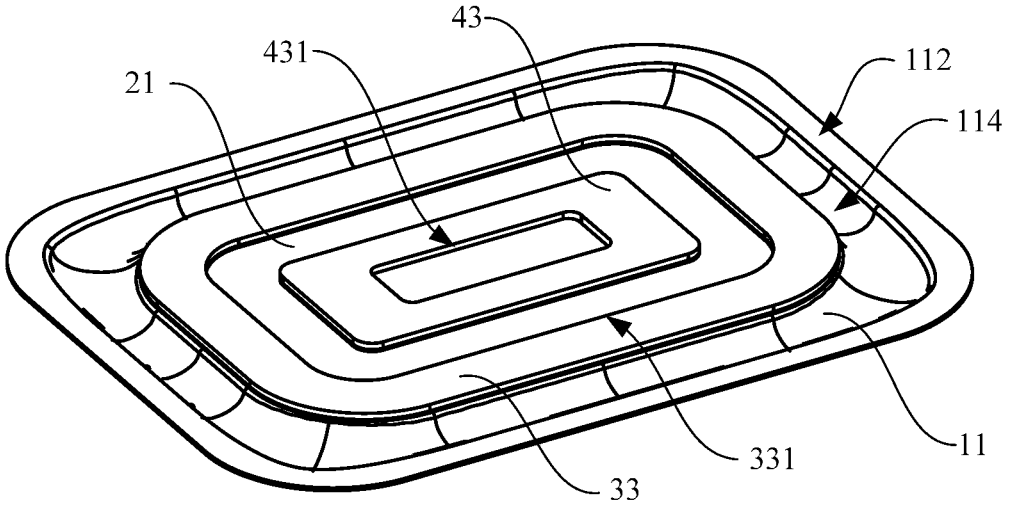
FIG. 16 is a stereoscopic structural schematic view of the fourth embodiment of the diaphragm assembly according to embodiments of the present invention.
Figure 17:
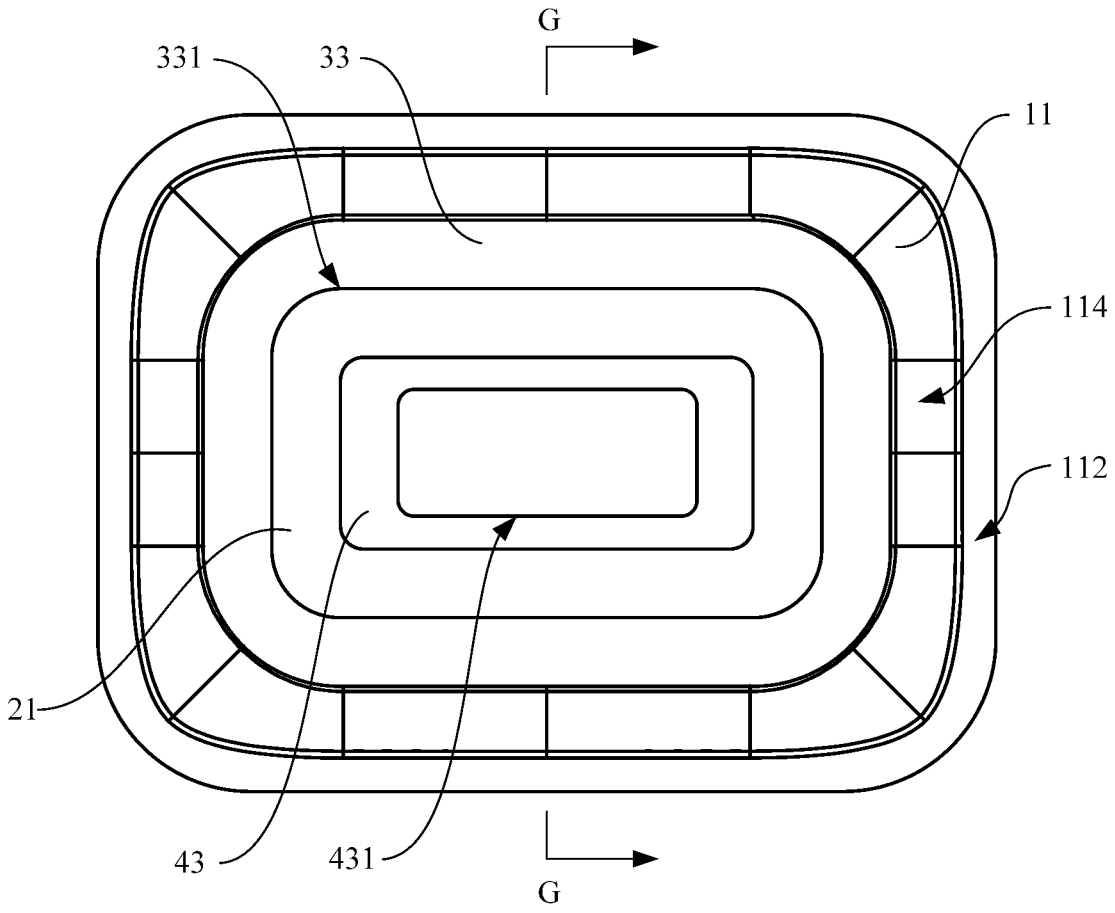
FIG. 17 is a vertical view of the fourth embodiment of the diaphragm assembly according to embodiments of the present invention.
Figure 18:
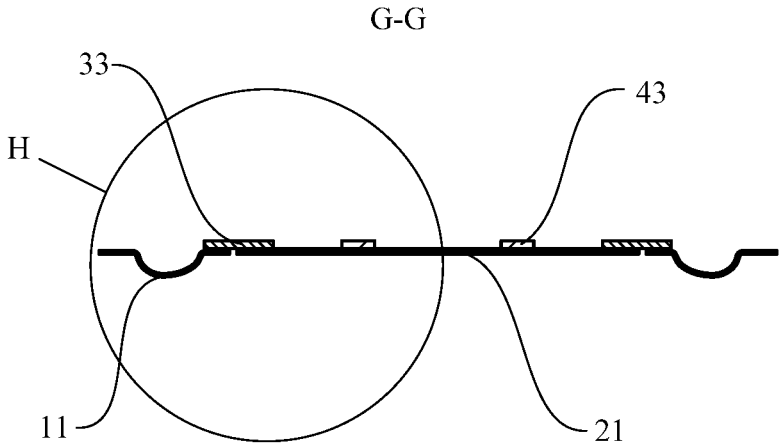
FIG. 18 is a schematic view of a section cut open along the plane G-G of the fourth embodiment of the diaphragm assembly according to embodiments of the present invention.
Figure 19:
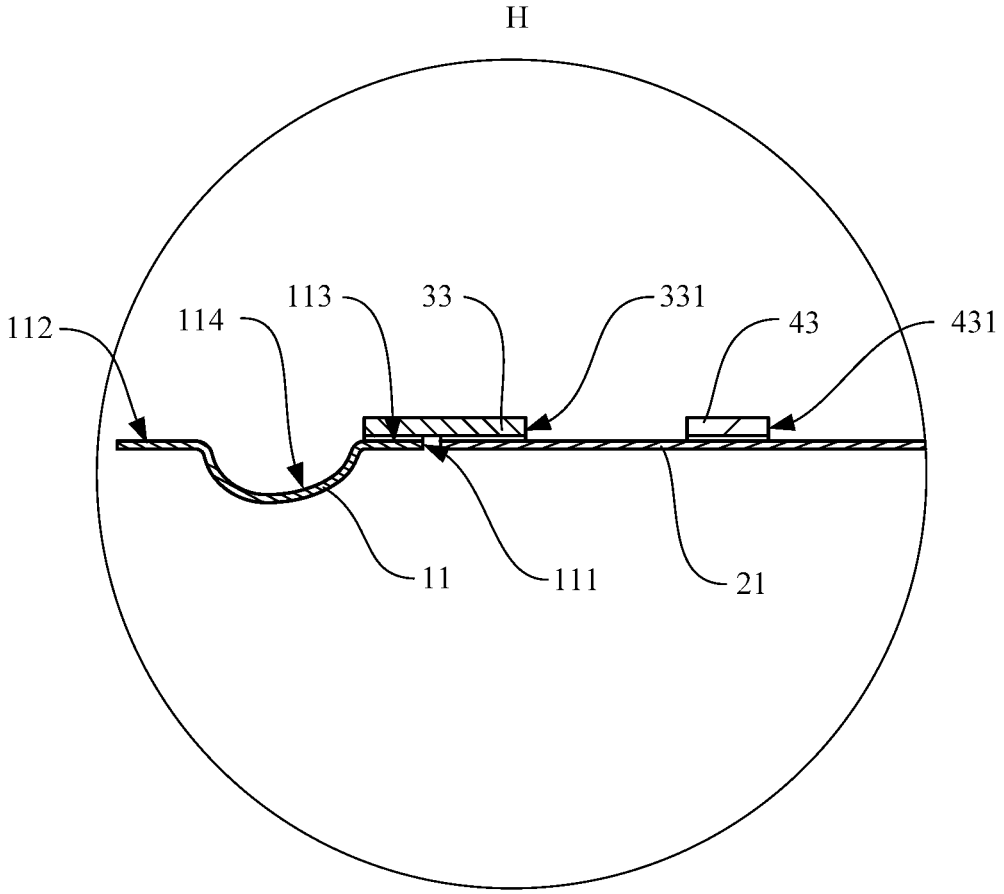
FIG. 19 is a local enlarged schematic view at the position H of the fourth embodiment of the diaphragm assembly according to embodiments of the present invention.
Figure 20:
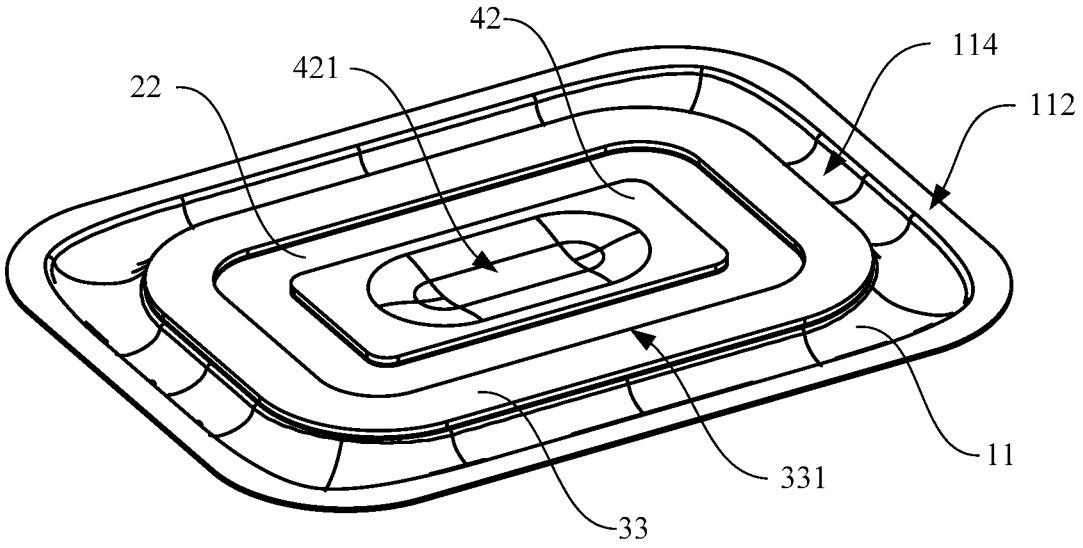
FIG. 20 is a stereoscopic structural schematic view from one visual angle of the fifth embodiment of the diaphragm assembly according to embodiments of the present invention.
Figure 21:
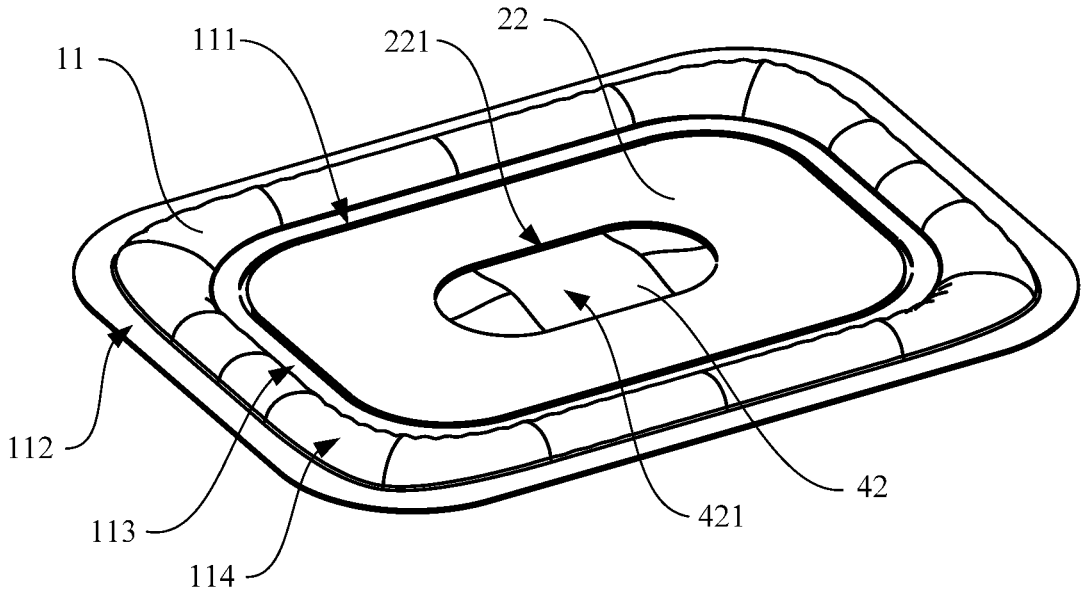
FIG. 21 is a stereoscopic structural schematic view from another visual angle of the fifth embodiment of the diaphragm assembly according to embodiments of the present invention.
Figure 22:
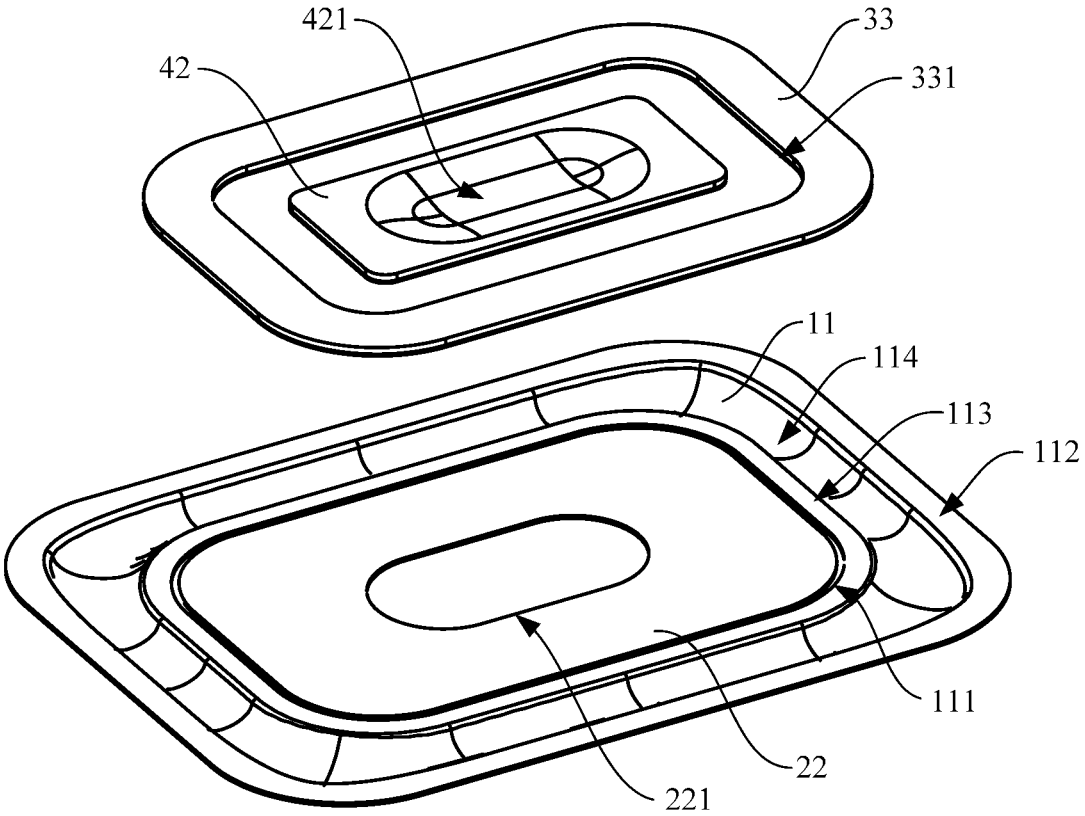
FIG. 22 is an exploded structural schematic view of the fifth embodiment of the diaphragm assembly according to embodiments of the present invention.
Figure 23:
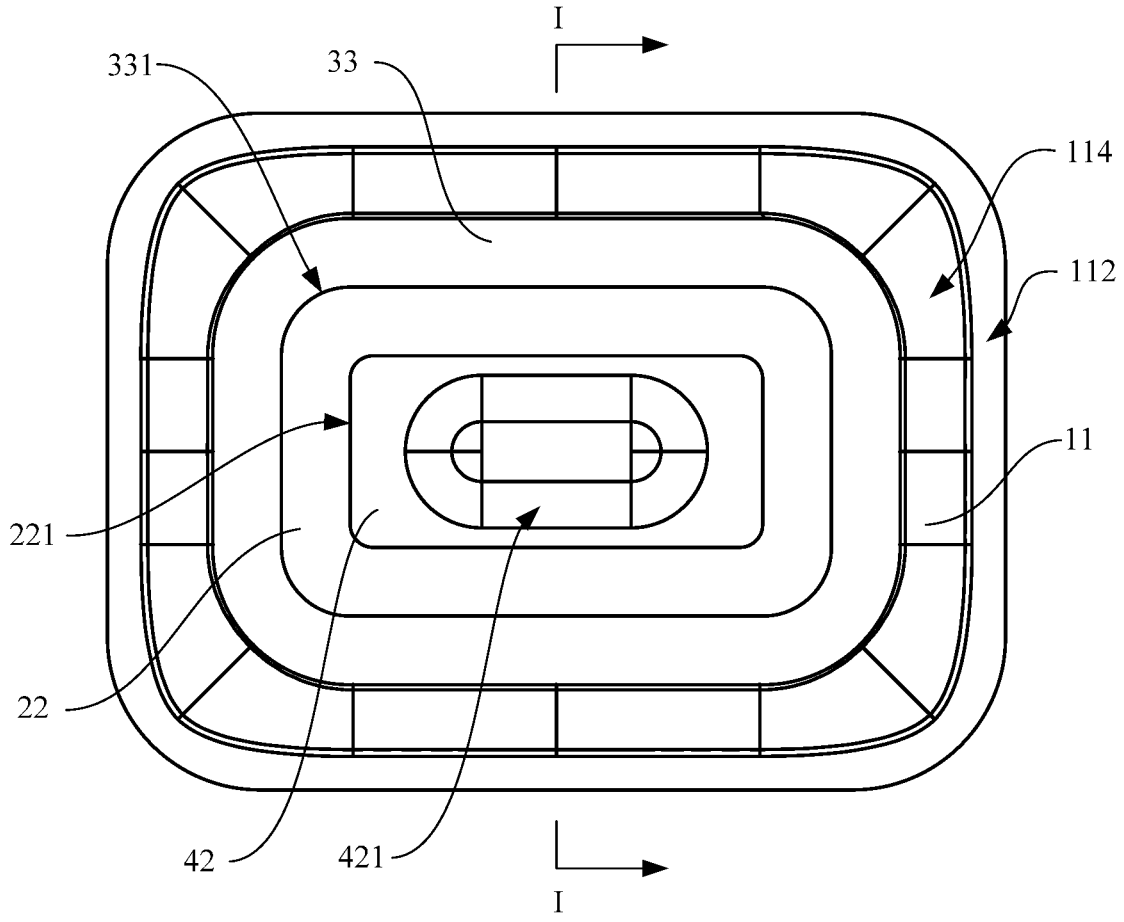
FIG. 23 is a vertical view of the fifth embodiment of the diaphragm assembly according to embodiments of the present invention.
Figure 24:
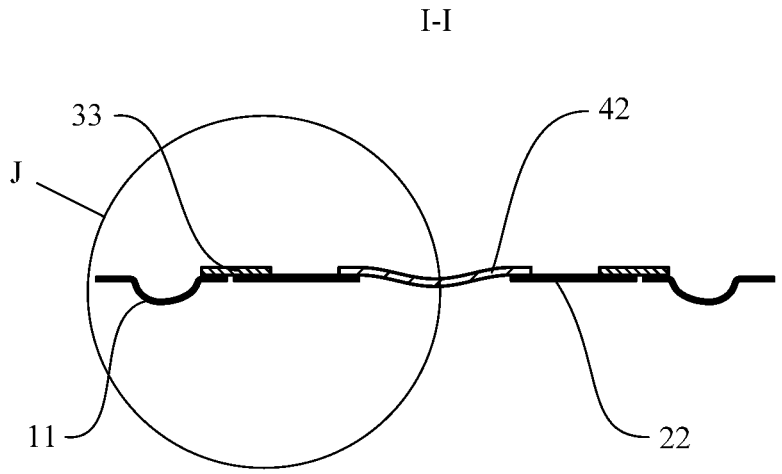
FIG. 24 is a schematic view of a section cut open along the plane I-I of the fifth embodiment of the diaphragm assembly according to embodiments of the present invention.
Figure 25:
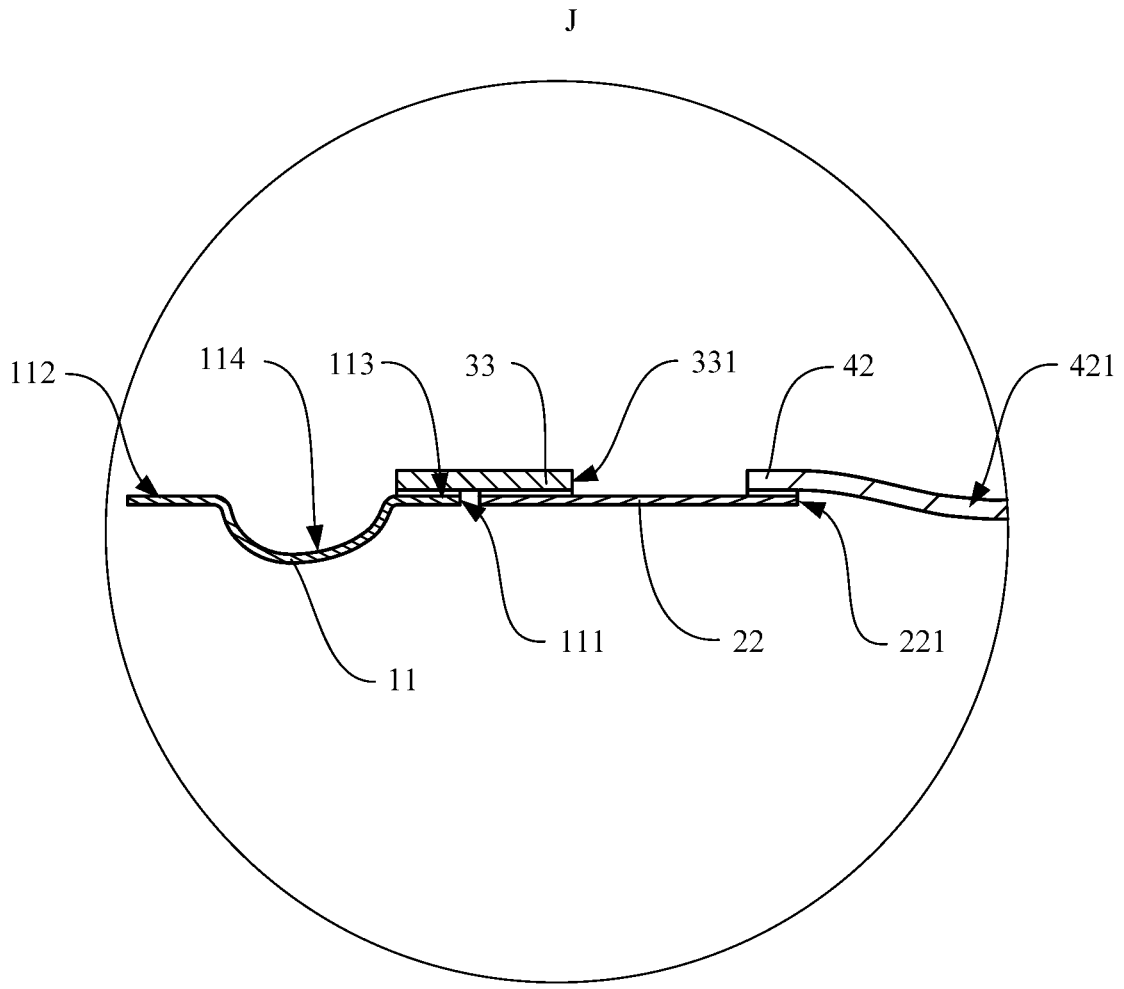
FIG. 25 is a local enlarged schematic view at the position J of the fifth embodiment of the diaphragm assembly according to embodiments of the present invention.

FIG. 1-25 are structural schematic views of five different diaphragm assemblies according to the embodiments of the present disclosure, wherein FIG. 4 is a structural schematic view of a section cut open along a plane A-A of the first embodiment of diaphragm assembly as shown in FIG. 3; FIG. 9 is a structural schematic view of a section cut open along a plane C-C of the second embodiment of diaphragm assembly as shown in FIG. 8; FIG. 14 is a structural schematic view of a section cut open along a plane E-E of the third embodiment of diaphragm assembly as shown in FIG. 13; FIG. 18 is a structural schematic view of a section cut open along a plane G-G of the fourth embodiment of diaphragm assembly as shown in FIG. 17; FIG. 24 is a structural schematic view of a section cut open along a plane I-I of the fifth embodiment of diaphragm assembly as shown in FIG. 23; FIG. 5 is a local enlarged schematic view of the position B as shown in FIG. 4; FIG. 10 is a local enlarged schematic view of the position D as shown in FIG. 9; FIG. 15 is a local enlarged schematic view of the position F as shown in FIG. 14; FIG. 19 is a local enlarged schematic view of the position H as shown in FIG. 18; and FIG. 25 is a local enlarged schematic view of the position J as shown in FIG. 24.

With reference to FIG. 1-25, the diaphragm assembly includes a diaphragm body and an intermediate patch plate, wherein the intermediate patch plate is connected to the diaphragm body. The diaphragm body includes a first diaphragm body 11 and second a diaphragm body 21 (or 22), wherein the first diaphragm body 11 is provided with a first hole 111; and the second diaphragm body 21 (or 22) at least partially covers the first hole 111 of the first diaphragm body 11. In other words, the projection of the second diaphragm body 21 (or 22) in the axial direction of the diaphragm assembly has an overlapped portion with the first hole 111. In the present application, the axial direction of the diaphragm assembly is basically consistent with the thick direction of the diaphragm assembly; and the diaphragm assembly moves in the axial direction when it is under drive. With reference to FIGS. 3, 8, 13, 17, and 23, the axial direction of the diaphragm assembly is perpendicular to the paper surface. The intermediate patch plate includes a first intermediate patch plate 31 (or 32, or 33), wherein the first intermediate patch plate 31 (or 32, or 33) is connected to the first diaphragm body 11 and the second diaphragm body 21 (or 22); in other words, the first intermediate patch plate 31 (or 32, or 33) conjoins between the first diaphragm body 11 and the second diaphragm body 21 (or 22); alternatively, the first diaphragm body 11 and the second diaphragm body 21 (or 22) are conjoined by means of the first intermediate patch plate 31 (or 32, or 33), such that the first diaphragm body 11 and the second diaphragm body 21 (or 22) maintain certain relative positions.

A minimum resonance frequency of the first diaphragm body 11 and the second diaphragm body 21 (or 22) can be changed by adjusting the rigidities of the first diaphragm body 11 and the second diaphragm body 21 (or 22), the masses of the first diaphragm body 11, the second diaphragm body 21 (or 22) and the intermediate patch plate, and other features; specifically, the diaphragm assembly can have an expected acoustic performance by performing the adjustment according to an acoustic performance simulation result. During operation, the first diaphragm body 11 and the second diaphragm body 21 (or 22) cooperate with the first intermediate patch plate 31 (or 32, or 33) to generate a plurality of resonance modes; and the middle frequency sensitivity of the entire diaphragm assembly can be smoother.

The diaphragm bodies are made from a thin film material suitable for reciprocating vibration under drive; the materials for making the first diaphragm body 11 and the second diaphragm body 21 (or 22) include but not limited to a paper film, a metal film, a macromolecule film, composite diaphragms (for example, a carbon fiber diaphragm, a biological composite diaphragm) and the like. The specific materials of the first diaphragm body 11 and the second diaphragm body 21 (or 22) can be selected according to the frequency response characteristic that the diaphragm assembly is expected to have. The first diaphragm body 11 and the second diaphragm body 21 (or 22) can select the same material, and can also select different materials.

The shapes of the diaphragm bodies can be designed according to an application scenario of the diaphragm assembly and the frequency characteristic that the diaphragm assembly is expected to have; the outer contours of the first diaphragm body 11 and the second diaphragm body 21 (or 22) can be circular, elliptical, rectangular, polygonal or other shapes suitable for practical use. The shape of the second diaphragm body 21 (or 22) can be similar to that of the first diaphragm body 11, and can also be totally different. The shape of the first hole 111 of the first diaphragm body 11 can be basically the same as the outer contour shape of the first diaphragm body 11. The outer contour shape of the second diaphragm body 21 (or 22) can also be basically the same as the shape of the first hole 111. In some embodiments, with reference to FIG. 1-25, the outer contours of the second diaphragm body 21 (or 22) and the first diaphragm body 11 are both basically rectangular; the contour of the first hole 111 is also basically rectangular; the outer edge of the first diaphragm body 11 basically has the same shape as outer edges of the first hole 111 and the second diaphragm body 21 (or 22) and are in one-to-one correspondence with each other. The frequency response characteristic of the diaphragm assembly can be changed by adjusting the shapes and sizes of the first diaphragm body 11 and the second diaphragm body 21 (or 22) without changing the overall size of the diaphragm assembly.

Figure 26:
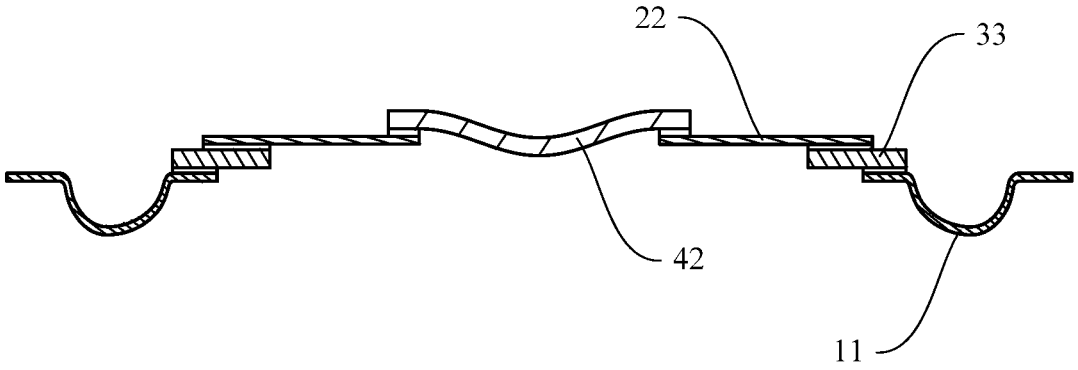
FIG. 26 is a connection diagram of the diaphragm assembly according to some embodiments of the present disclosure.

The second diaphragm body 21 (or 22) can cover the entire first hole 111, and can also cover only some region of the first hole 111. The projection of the second diaphragm body 21 (or 22) in the axial direction of the first diaphragm body 11 can have an overlapped portion with the first diaphragm body 11, and can also only have an overlapped portion with the first hole 111. FIG. 26 is a connection diagram of a diaphragm assembly according to one embodiment of the present disclosure. For example, in one embodiment, as shown in FIG. 26, the outer contour of the second diaphragm body 21 (or 22) is larger than the size of the first hole 111, and the second diaphragm body 21 (or 22) can cover part of edge of the first hole 111. In another embodiment, with reference to FIG. 1-25, the outer contour of the second diaphragm body 21 (or 22) is smaller than the size of the first hole 111, and a certain transverse gap is disposed between the second diaphragm body 21 (or 22) and an inwall of the first hole 111, wherein the "transverse" refers to a direction perpendicular to the axis of the diaphragm assembly. In other words, the projection of the second diaphragm body 21 (or 22) in the axial direction of the diaphragm assembly does not overlap with a physical portion (namely a portion consisting of diaphragm material) of the first diaphragm body 11.

The second diaphragm body can have an enclosed structure, and can also be provided with a second hole 221. In the present application, the "enclosed structure" means that a complete surface is provided and no through hole in the axial direction is disposed in a region within the outer contour. In one embodiment, with reference to the three different diaphragm assemblies shown in FIGS. 1-5 and 11-19, the second diaphragm body 21 has an enclosed structure, and has a shape corresponding to the first hole 111. In another embodiment, with reference to the two diaphragm assemblies shown in FIGS. 6-10 and 20-25, the second diaphragm body 22 is provided with a second hole 221, wherein the second hole 221 is disposed in the middle of the second diaphragm body 22 and penetrates through the second diaphragm body 22 in the axial direction of the second diaphragm body 22. The shape of the second hole 221 can be the same as the outer contour shape of the second diaphragm body 22, and can also be other shapes configured according to the acoustic performance that the diaphragm assembly is expected to have.

Figure 27:
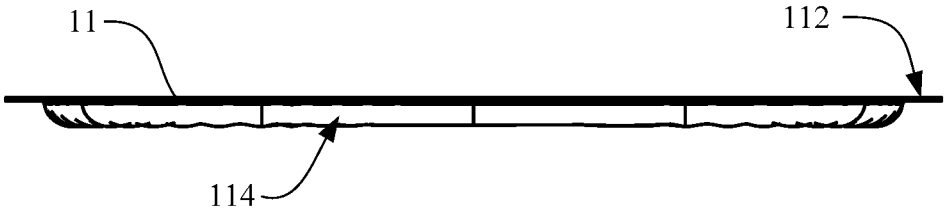
FIG. 27 is a side view of the first diaphragm body according to some embodiments of the present disclosure.

FIG. 27 is a side view of a first diaphragm body according to some embodiments of the present disclosure. With reference to FIG. 1-27, in some embodiments, the first diaphragm body 11 includes an outer connecting portion 112, an inner connecting portion 113, and a corrugated rim 114 disposed between the outer connecting portion 112 and the inner connecting portion 113; that is, the outer connecting portion 112 is disposed surrounding the corrugated rim 114, and the corrugated rim 114 is disposed surrounding the inner connecting portion 113. The outer connecting portion 112 is used to fix the diaphragm assembly on an apparatus to which the diaphragm assembly is applied, for example, on a frame 61 of a loudspeaker. The corrugated rim 114 (also known as surround) is used to support the vibration of the diaphragm assembly, such that the diaphragm assembly can move in the axial direction but cannot move transversely; the corrugated rim 114 is generally a bending structure in an arc shape, an undulating shape and the like. The number of the corrugated rims 114 can be one, two or more. The number and bending direction of the corrugated rims 114 can be specifically determined according to the expected acoustic performance of the diaphragm assembly. The outer connecting portion 112 can be basically planar, thereby facilitating the fixation of the diaphragm assembly. The inner connecting portion 113 can also be basically planar; the inner connecting portion 113 and the outer connecting portion 112 can be basically located on the same plane. The first intermediate patch plate 31 (or 32, or 33) is connected to the inner connecting portion 113. Optionally, an edge of the first intermediate patch plate 31 (or 32, or 33) does not exceed an edge of the inner connecting portion 113, so as to avoid the corrugated rim 114.

The intermediate patch plate can be made from a material with a certain rigidity, such as a metal sheet, a hard macromolecular material, a composite plate and the like. The intermediate patch plate is connected to the diaphragm body, and can reduce the deformation of the diaphragm body in a high frequency band, thereby ensuring the quality of the high frequency. In some embodiments, the intermediate patch plate is an aluminum sheet; the aluminum sheet has a great rigidity, and is not easy to deform; furthermore, aluminum is not a magnetic material, and has no impact on the magnetic induction of a voice coil, thereby avoiding generating an adverse effect on the vibration of the voice coil. The frequency response characteristic of the diaphragm assembly can be adjusted by adjusting the mass of the intermediate patch plate and selecting the intermediate patch plates made from different materials.

The first diaphragm body 11 and the second diaphragm body 21 (or 22) can be adhered at a certain position on the first intermediate patch plate 31 (or 32, or 33) by means of an adhesive agent, an adhesive tape or other connecting structures or connectors, such that the first diaphragm body 11 and the second diaphragm body 21 (or 22) are firmly connected to the first intermediate patch plate 31 (or 32, or 33). The first intermediate patch plate 31 (or 32, or 33) includes a first side surface and second side surface which are opposite; the first diaphragm body 11 and the second diaphragm body 21 (or 22) can be connected to the same side surface of the first intermediate patch plate 31 (or 32, or 33), and can also be connected to different side surfaces of the first intermediate patch plate 31 (or 32, or 33); specifically, an appropriate connection order can be selected according to different configuration space and assembly modes of the diaphragm assembly. When the first intermediate patch plate 31 (or 32, or 33) is in a tabular shape and has a uniform thickness, the first side surface is basically in parallel with the second side surface.

In one embodiment, with reference to FIG. 26, the first diaphragm body 11 is connected to the first side surface of the first intermediate patch plate 33; the second diaphragm body 22 is connected to the second side surface of the first intermediate patch plate 33; the connecting part of the first diaphragm body 11 and the first intermediate patch plate 33 and the connecting part of the second diaphragm body 22 and the first intermediate patch plate 33 have a certain distance in the axial direction of the diaphragm assembly; and the first intermediate patch plate 33 separates the first diaphragm body 11 from the second diaphragm body 22 in the axial direction.

In another embodiment, with reference to FIG. 1-25, the first diaphragm body 11 and the second diaphragm body 21 (or 22) are both connected to the first side surface of the first intermediate patch plate 31 (or 32, or 33), or are both connected to the second side surface of the first intermediate patch plate 31 (or 32, or 33). Therefore, the first diaphragm body 11 and the second diaphragm body 21 (or 22) are basically at the same height in the axial direction of the diaphragm assembly.

In some embodiments, with reference to FIG. 1-10, the first intermediate patch plate 31 (or 32) has an enclosed structure. The first intermediate patch plate 31 (or 32) completely covers the first hole 111. The first intermediate patch plate 31 (or 32) can be basically in a tabular shape, and can also be provided with a concavity portion.

In one embodiment, with reference to FIG. 1-5, the first intermediate patch plate 31 is basically in the tabular shape, and the second diaphragm body 22 can have an enclosed structure, and can also be provided with a hole. The second diaphragm body 22 is adhered to one side of the first intermediate patch plate 31.

In one embodiment, with reference to FIG. 6-10, a first concavity portion 321 is disposed in the middle of the first intermediate patch plate 32; the second diaphragm body 22 is provided with a second hole 221; the position of the second hole 221 corresponds to the position of the first concavity portion 321; and the size of the second hole 221 adapts to the size of the edge of the first concavity portion 321. The second hole 221 can have the same size as the edge of the first concavity portion 321, and can also be larger than the edge of the first concavity portion 321, such that the first concavity portion 321 can be accommodated in the second hole 221. The first concavity portion 321 can be configured to enable the middle frequency sensitivity of the diaphragm assembly to be smoother, such that the diaphragm assembly can obtain a better acoustic performance during operation. The first concavity portion 321 can be configured to extend the high frequency, but may have a certain impact on the performance of a magnetic circuit when applied to a loudspeaker. A person skilled in the art can select whether to configure the first concavity portion 321, and can select the parameters such as the shape and depth of the first concavity portion 321, according to the expected frequency characteristic and application scenario of the diaphragm assembly.

In some embodiments, with reference to FIG. 11-25, the intermediate patch plate further includes a second intermediate patch plate 41 (or 42, or 43). The first intermediate patch plate 33 is provided with a third hole 331, and the second intermediate patch plate 41 (or 42, or 43) is disposed in the third hole 331. The second intermediate patch plate 41 (or 42, or 43) is connected to the second diaphragm body 21 (or 22), and has a certain gap to an inwall of the third hole 331. In some embodiments, the first diaphragm body 11, the first intermediate patch plate 33, the second diaphragm body 21 (or 22), and the second intermediate patch plate 41 (or 42, or 43) are sequentially disposed from an outer side to the center of the diaphragm assembly. The lowest resonance frequency of the second diaphragm body 21 (or 22) can be adjusted by adjusting the rigidity of the second diaphragm body 21 (or 22) and the masses of the second diaphragm body 21 (or 22) and the second intermediate patch plate 41 (or 42, or 43). The second intermediate patch plate 41 (or 42, or 43) can be configured to enable the diaphragm assembly to generate more resonance modes, such that the middle frequency curve of the diaphragm assembly is smoother.

The shape of the second intermediate patch plate 41 (or 42, or 43) can match the shapes of the second diaphragm body 21 (or 22) and the third hole 331. The outer contour of the second intermediate patch plate 41 (or 42, or 43) can be smaller than the outer contour of the second diaphragm body 21 (or 22); and the edge of the second intermediate patch plate 41 (or 42, or 43) does not protrude out of the outer edge of the second diaphragm body 21 (or 22). When the second diaphragm body 22 is provided with a second hole 221, the size of the second intermediate patch plate 41 (or 42, or 43) shall adapt to the size of the second hole 221, such that the second intermediate patch plate 41 (or 42, or 43) can be firmly connected to the second diaphragm body 22. The second intermediate patch plate 41 (or 42, or 43) is connected to the second diaphragm body 21 (or 22); therefore, the size of the second intermediate patch plate 41 (or 42, or 43) is small, thereby improving the resonance frequency of the second intermediate patch plate 41 (or 42, or 43), to avoid generating a sharp peak and valley in a high frequency part, improving the sound quality of the diaphragm assembly.

The second intermediate patch plate 41 (or 42, or 43) and the first intermediate patch plate can be made from the same material, and can also be made from different materials; the specific material can be selected according to the acoustic performance that the diaphragm assembly is expected to have.

The second intermediate patch plate 41 (or 42, or 43) can have an enclosed structure, and can also be provided with a fourth hole 431; the specific design can be made according to the acoustic performance simulation result. The frequency response characteristic of the diaphragm assembly can be adjusted by adjusting the shape of the second intermediate patch plate 41 (or 42, or 43). In one embodiment, with reference to the two diaphragm assemblies shown in FIGS. 11-15 and 20-25, the second intermediate patch plate 41 (or 42) has an enclosed structure. In another embodiment, with reference to the diaphragm assemblies shown in FIG. 16-19, the second intermediate patch plate 43 is provided with a fourth hole 431; the fourth hole 431 is disposed in the middle of the second intermediate patch plate 43; the second diaphragm body 21 has an enclosed structure; and after the second intermediate patch plate 43 is connected to the second diaphragm body 21, the second diaphragm body 21 covers the fourth hole 431.

In some embodiments, with reference to FIG. 20-25, a second concavity portion 421 is disposed in the middle of the second intermediate patch plate 42, and the second diaphragm body 22 is provided with a second hole 221. The position of the second hole 221 corresponds to the position of the second concavity portion 421, and the size of the second hole 221 matches the size of the edge contour of the second concavity portion 421. Specifically, the second hole 221 can have the same size as the edge contour of the second concavity portion 421, and can also be larger than the edge contour of the second concavity portion 421, such that the second concavity portion 421 can be accommodated in the second hole 221. The second concavity portion 421 can be configured to extend the high frequency, but may have a certain impact on the performance of a magnetic circuit when applied to a loudspeaker. A person skilled in the art can select whether to configure the second concavity portion 421, and can select the parameters such as the shape and depth of the second concavity portion 421, according to the expected frequency characteristic and application scenario of the diaphragm assembly.

The second diaphragm body 21 (or 22) includes two opposite side surfaces; the first intermediate patch plate 33 and the second intermediate patch plate 41 (or 42, or 43) can be connected to the same side surface of the second diaphragm body 21 (or 22) (refer to FIGS. 1-25), and can also be connected to different side surfaces of the second diaphragm body 21 (or 22) (refer to FIG. 26). The specific connection can be selected according to the factors such as the application scenario space and assembly order of the diaphragm assembly. In other words, the first intermediate patch plate 33 and the second intermediate patch plate 41 (or 42, or 43) can have the same height in the axial direction of the diaphragm assembly, and can also be separated by a certain distance.

Figure 28:
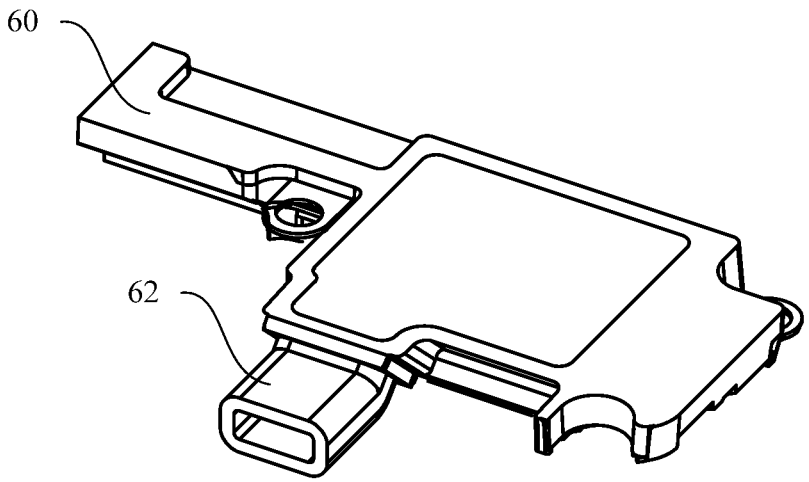
FIG. 28 is a schematic view of the appearance of the loudspeaker module according to some embodiments of the present disclosure.
Figure 29:
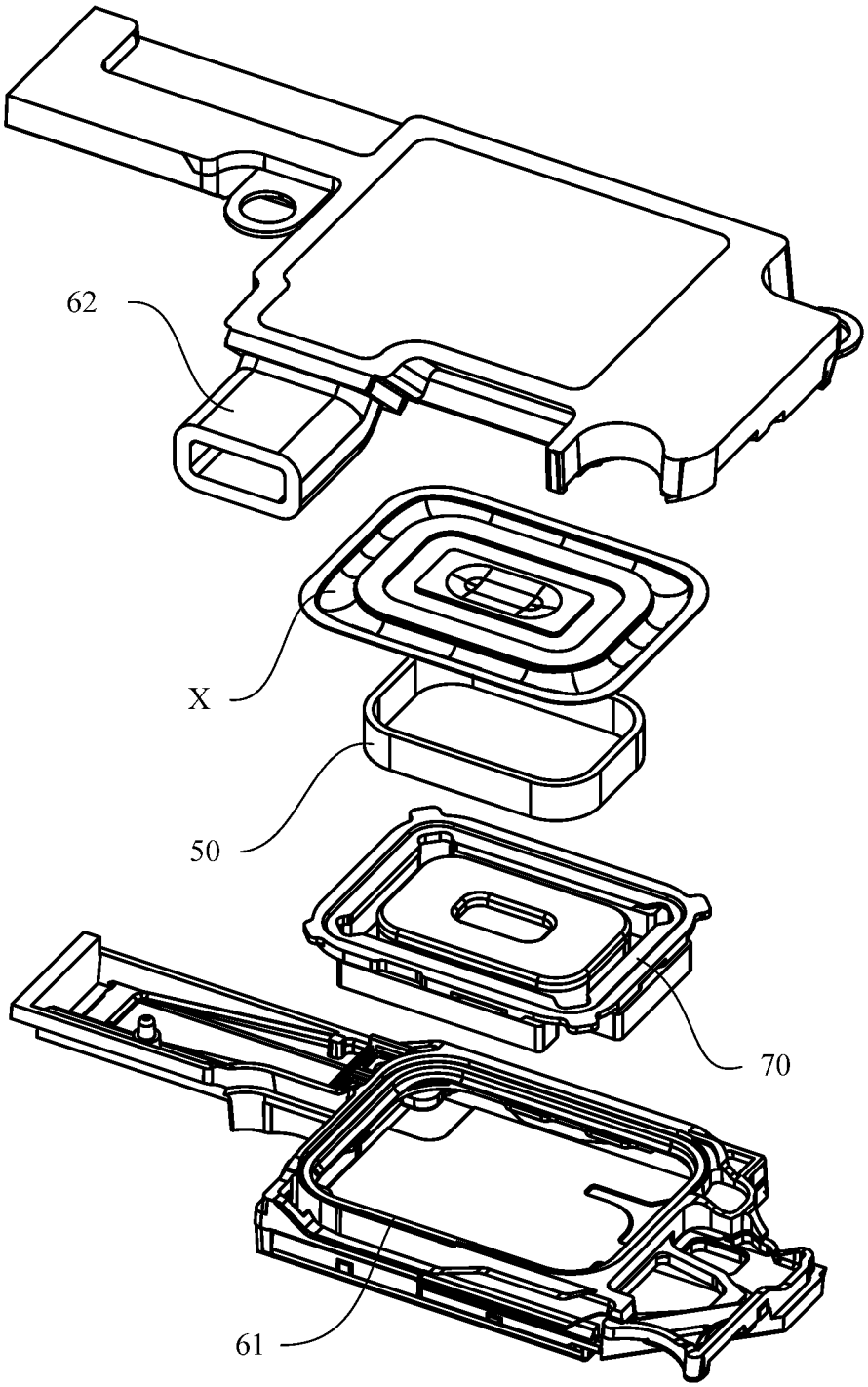
FIG. 29 is an exploded structural schematic view of the loudspeaker module according to some embodiments of the present disclosure.

The diaphragm assembly in at least some embodiments of the present disclosure can be applied to an electro-acoustic conversion device; optionally, the diaphragm assembly can be applied to a loudspeaker module. FIG. 28-29 are structural schematic views of the loudspeaker module according to one embodiment of the present disclosure. With reference to FIG. 28-29, the loudspeaker module includes a frame 61, a magnetic circuit system 70, and a vibration system. The vibration system includes a voice coil 50 and at least one diaphragm assembly as described above. The frame 61 is used to fix and support the diaphragm assembly. Specifically, the shape of the frame 61 matches the outer contour of the diaphragm assembly X, and part of the outer edge of the diaphragm assembly X is fixedly connected to the frame 61. When the first diaphragm body 11 includes the outer connecting portion 112, the outer connecting portion 112 can be fixed on the frame 61 by means of bonding, crimping or other connection modes, thereby enabling the diaphragm assembly to maintain a certain tension. The magnetic circuit system 70 is used to form a magnetic field; and the voice coil 50 is disposed in the magnetic field formed by the magnetic circuit system 70, and is connected to the diaphragm assembly X. When the magnetic circuit system 70 receives an electrical signal containing sound information, the magnetic circuit system will generate a corresponding varying magnetic field; under the drive of the varying magnetic field, the voice coil 50 reciprocates in the axial direction in the magnetic field, so as to drive the diaphragm assembly X to vibrate, and push the air to generate sound waves.

In some embodiments, the loudspeaker module includes a housing 60, wherein the housing 60 is provided with a sound guide tube 62; an accommodation space is formed in the housing 60; and the diaphragm assembly X divides the accommodation space into a front cavity and a rear cavity. The sound guide tube 62 is connected to the front cavity; the sound waves generated by the vibration of the diaphragm assembly X is propagated from the sound guide tube 62 to outside of the loudspeaker module; and the magnetic circuit system 70 is disposed in the rear cavity. The frame 61 is fixed in the housing 60, or the frame 61 can be a part of the housing 60.

In a miniature loudspeaker module, limited by the system space for configuring the loudspeaker module, the sound guide tube 62 is generally disposed in a side direction of the housing 60; that is, the sound guide tube 62 is disposed in a side direction of the diaphragm assembly X, and forms a certain angle (for example, 90 degrees) with the axial direction of the diaphragm assembly X; when the diaphragm assembly X vibrates, the air in the front cavity is pushed to flow out from the guide tube, so as to form side sound. The sound generated by the loudspeaker module resonates with the front cavity and therefore generates a sharp peak in the middle frequency range, thereby greatly affecting the sense of hearing. In a comparative technical solution, the problem of generating a sharp peak and valley in the middle frequency can be effectively solved by adding an acoustic resonant cavity which connects with the front cavity, however, this solution will inevitably increase the overall size of the loudspeaker module. In the application of the diaphragm assembly in at least some embodiments of the present disclosure, by adjusting the parameters such as the rigidity of the second diaphragm body 21 (or 22), and the masses of the second diaphragm body 21 (or 22) and/or the second intermediate patch plate 41 (or 42, or 43) when the diaphragm assembly includes the second intermediate patch plate, the lowest resonance frequency of the second diaphragm is ensured to be close to the resonance frequency of the front cavity; therefore, the intermediate frequency curve of the diaphragm assembly is smoother owing to the generation of two formants. Compared with the solution of adding an additional acoustic resonant cavity, the diaphragm assembly in the embodiments of the present disclosure does not occupy additional space, thereby facilitating the miniaturization of the loudspeaker module.

Figure 30:
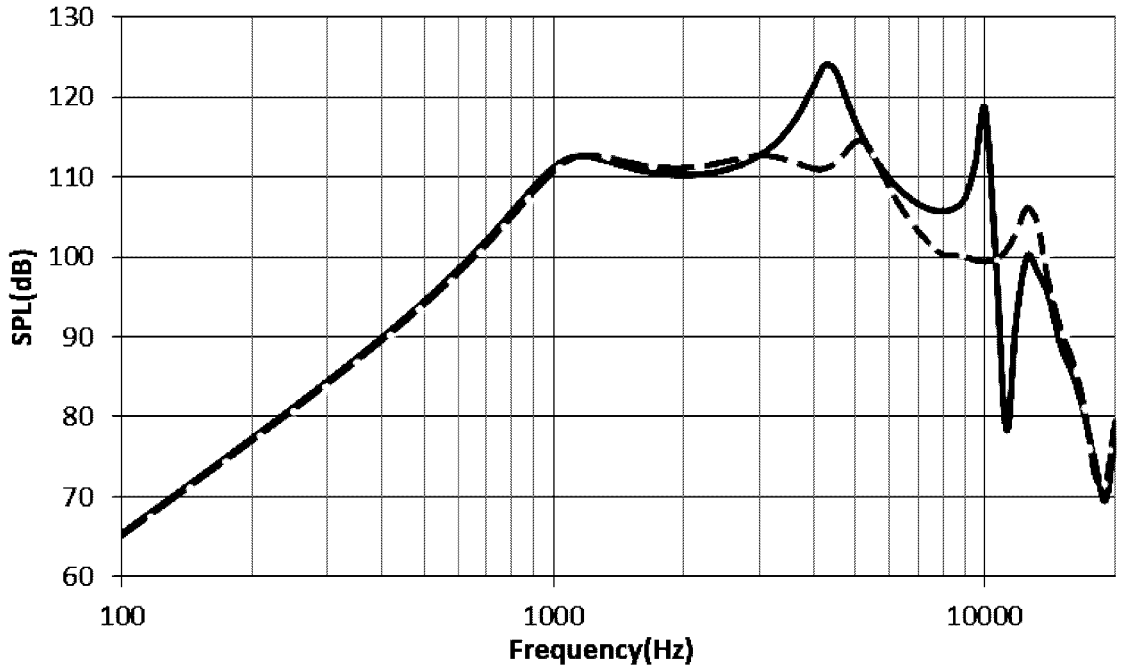
FIG. 30 is a comparison diagram of acoustic performance simulation results between the loudspeaker module in the embodiments of the present disclosure and the conventional loudspeaker module.

FIG. 30 is a comparison diagram of acoustic performance simulation results between the loudspeaker module in the embodiments of the present disclosure and the conventional loudspeaker module which does not adopt the diaphragm assembly in the embodiment of the present disclosure. In FIG. 30, the ordinate denotes sound pressure level (SPL); the abscissa denotes frequency; the solid line represents the frequency response characteristic of the conventional loudspeaker module; and the dotted line represents the frequency response characteristic of the loudspeaker module in the embodiments of the present disclosure. It can be recognized from the comparison of the two curves in FIG. 30 that the use of the diaphragm assembly in the embodiments of the present disclosure enables the intermediate frequency sensitivity of the loudspeaker module in the embodiments of the present disclosure to be smoother, the low frequency sensitivity is basically not affected, and no sharp peak or valley is generated in the high frequency range, thereby effectively improving the sense of hearing of people.

The loudspeaker module in at least some embodiments of the present disclosure can be applied to an electronic device. In the present application, the electronic device can be any electronic device having the sound generation requirement, including but not limited to a headphone, an acoustics, a mobile phone, a computer, a game console and the like.

Provided in embodiments of the present disclosure are a diaphragm assembly, a loudspeaker module and an electronic device, the diaphragm assembly including a diaphragm body and an intermediate patch plate, wherein the diaphragm body includes a first diaphragm body and a second diaphragm body; the first diaphragm body is provided with a first hole; the intermediate patch plate includes a first intermediate patch plate; the second diaphragm body at least partially cover the first hole; the first intermediate patch plate is respectively connected to the first diaphragm body and the second diaphragm body; the first intermediate patch plate is configured to have an enclosed structure, or the intermediate patch plate includes a second intermediate patch plate connected to the second diaphragm body, such that the mid-high frequency curves of the loudspeaker module are smoother, thereby effectively improving the mid-high frequency tone quality; furthermore, the diaphragm assembly has a compact structure, and no extra acoustic resonant cavity is required to be disposed in the loudspeaker module, thereby facilitating the miniaturization of the loudspeaker module and the electronic device.

The descriptions above are only preferred embodiments of the present disclosure, but are not intended to limit the present disclosure. For a person skilled in the art, the present disclosure may have various changes and variations. Any modifications, equivalent substitutions, improvements and the like made within the spirit and principles of the present disclosure are all intended to be concluded in the protection scope of the present disclosure.

We claim:

1. A diaphragm assembly, comprising:

a diaphragm body, comprising a first diaphragm body (11) and a second diaphragm body (21 or 22), the first diaphragm body (11) is provided with a first hole (111), and the second diaphragm body (21 or 22) at least partially covers the first hole (111); and an intermediate patch plate, connected to the diaphragm body, and comprising first intermediate patch plate (31 or 32), the first intermediate patch plate (31 or 32) is connected to the first diaphragm body (11) and the second diaphragm body (21 or 22), and the first intermediate patch plate (31 or 32) has an enclosed structure;

wherein the second diaphragm body (21) has an enclosed structure.

2. The diaphragm assembly according to claim 1, wherein a first concavity portion (321) is disposed in the middle of the first intermediate patch plate (32); the second diaphragm body (22) is provided with a second hole (221); and the first concavity portion (321) is accommodated in the second hole (221).

3. The diaphragm assembly according to claim 1, wherein the first diaphragm body (11) comprises an outer connecting portion (112), an inner connecting portion (113), and a corrugated rim (114) disposed between the outer connecting portion (112) and the inner connecting portion (113); the first intermediate patch plate (31 or 32) is connected to the inner connecting portion (113); and the outer connecting portion (112) is used to fixedly mount the diaphragm assembly.

4. The diaphragm assembly according to claim 1, wherein the second diaphragm body (22) is provided with a second hole (221).

5. The diaphragm assembly according to claim 1, wherein the first diaphragm body (11) and the second diaphragm body (21 or 22) are connected to the same side surface of the first intermediate patch plate (31 or 32); or the first diaphragm body (11) and the second diaphragm body (21 or 22) are connected to different side surfaces of the first intermediate patch plate (31 or 32).

6. A diaphragm assembly, comprising:

a diaphragm body, comprising a first diaphragm body (11) and a second diaphragm body (21 or 22), the first diaphragm body (11) is provided with a first hole (111), and the second diaphragm body (21 or 22) at least partially covers the first hole (111); and an intermediate patch plate, connected to the diaphragm body, and comprising a first intermediate patch plate (33) and a second intermediate patch plate (41 or 42 or 43), the first intermediate patch plate (33) is provided with a third hole (331), the second intermediate patch plate (41 or 42 or 43) is disposed in the third hole (331), the first intermediate patch plate (33) is connected to the first diaphragm body (11) and the second diaphragm body (21 or 22), and the second intermediate patch plate (41 or 42 or 43) is connected to the second diaphragm body (21 or 22).

7. The diaphragm assembly according to claim 6, wherein the second intermediate patch plate (41 or 42) has an enclosed structure.

8. The diaphragm assembly according to claim 7, wherein a second concavity portion (421) is disposed in the middle of the second intermediate patch plate (42); the second diaphragm body (22) is provided with a second hole (221); and the second concavity portion (421) is accommodated in the second hole (221).

9. The diaphragm assembly according to claim 6, wherein the second intermediate patch plate (43) is provided with a fourth hole (431).

10. The diaphragm assembly according to claim 6, wherein a gap is disposed between the second intermediate patch plate (41 or 42 or 43) and inwall of the third hole (331).

11. The diaphragm assembly according to claim 6, wherein the first intermediate patch plate (33) and the second intermediate patch plate (41 or 42 or 43) are connected to the same side surface of the second diaphragm body (21 or 22); or the first intermediate patch plate (33) and the second intermediate patch plate (41 or 42 or 43) are connected to different side surfaces of the second diaphragm body (21 or 22).

12. The diaphragm assembly according to claim 6, wherein the first diaphragm body (11) comprises an outer connecting portion (112), an inner connecting portion (113), and a corrugated rim (114) disposed between the outer connecting portion (112) and the inner connecting portion (113); the first intermediate patch plate (33) is connected to the inner connecting portion (113); and the outer connecting portion (112) is used to fixedly mount the diaphragm assembly.

13. The diaphragm assembly according to claim 6, wherein the second diaphragm body (21) has an enclosed structure.

14. The diaphragm assembly according to claim 6, wherein the second diaphragm body (22) is provided with a second hole (221).

15. The diaphragm assembly according to claim 6, wherein the first diaphragm body (11) and the second diaphragm body (21 or 22) are connected to the same side surface of the first intermediate patch plate (33); or the first diaphragm body (11) and the second diaphragm body (21 or 22) are connected to different side surfaces of the first intermediate patch plate (33).

16. A loudspeaker module, comprising:

a frame (61);

a magnetic circuit system (70), used for forming a magnetic field; and a vibration system, comprising a voice coil (50) and the diaphragm assembly (X) as claimed in claim 7, wherein the diaphragm body is connected to the frame (61); the voice coil (50) is disposed in the magnetic field formed by the magnetic circuit system (70); the voice coil (50) is configured to drive the diaphragm assembly (X) to vibrate under the drive of the varying magnetic field generated by the magnetic circuit system (70).

* * * * *